United States Patent [19]

Norota et al.

[11] Patent Number: 4,521,364

[45] Date of Patent: Jun. 4, 1985

[54] FILAMENT-LIKE FIBERS AND BUNDLES THEREOF, AND NOVEL PROCESS AND APPARATUS FOR PRODUCTION THEREOF

[75] Inventors: Susumi Norota; Tsutomu Kiriyama; Tadashi Imoto; Toshinori Azumi, all of Iwakuni, Japan

[73] Assignee: Teijin Limited, Tokyo, Japan

[21] Appl. No.: 394,891

[22] Filed: Jul. 2, 1982

Related U.S. Application Data

[62] Division of Ser. No. 133,288, Mar. 24, 1980, Pat. No. 4,355,075.

[30] Foreign Application Priority Data

| | | | |
|---|---|---|---|
| Mar. 27, 1979 | [JP] | Japan | 54-35008 |
| Mar. 27, 1979 | [JP] | Japan | 54-35009 |
| Jul. 16, 1979 | [JP] | Japan | 54-89315 |
| Sep. 4, 1979 | [JP] | Japan | 54-112370 |

[51] Int. Cl.[3] ..... D01D 5/088

[52] U.S. Cl. ..... 264/176 F; 264/210.1; 264/210.5; 264/290.5; 425/72 S; 425/464; 428/369; 428/373; 428/397; 428/399; 428/400

[58] Field of Search ..... 264/176 F, 210.1, 210.5, 264/290.5, 178 R, 280; 425/72 S, 464; 428/369, 373, 397, 399, 400

[56] References Cited

U.S. PATENT DOCUMENTS

| | | | |
|---|---|---|---|
| 3,492,692 | 2/1970 | Soda et al. | 425/131.5 |
| 3,501,805 | 3/1970 | Douglas et al. | 425/131.5 |
| 4,146,378 | 3/1979 | Levecque et al. | 264/12 |
| 4,211,736 | 7/1980 | Bradt | 264/12 |
| 4,248,577 | 2/1981 | Bory et al. | 264/176 F |
| 4,380,570 | 4/1983 | Schwarz | 264/12 |
| 4,399,084 | 8/1983 | Sagawa et al. | 425/72 S |

FOREIGN PATENT DOCUMENTS

| | | | |
|---|---|---|---|
| 45-5043 | 2/1970 | Japan | 425/465 |
| 47-45617 | 11/1972 | Japan | 264/182 |
| 48-43566 | 12/1973 | Japan | 264/177 F |

*Primary Examiner*—Jeffery Thurlow
*Assistant Examiner*—Hubert C. Lorin
*Attorney, Agent, or Firm*—Wenderoth, Lind & Ponack

[57] ABSTRACT

A novel filament composed of at least one thermoplastic synthetic polymer, said filament being characterized by having (1) an irregular variation in the size of its cross section along its longitudinal direction, and (2) a coefficient of intrafilament cross-sectional area variation [CV(F)] of 0.05 to 1.0; and a novel bundle of said filament. The bundle of filament-like fibers can be produced by extruding a melt of a thermoplastic synthetic polymer through a spinneret having numerous small openings, which comprises extruding said melt from said spinneret, said spinneret having such a structure that discontinuous elevations are provided between adjacent small openings on the extruding side of the spinneret, and the melt extruded from one opening can move to and from the melt extruded from another opening adjacent thereto or vice versa through a depression existing between said elevation; and taking up the extrudates from the small openings while cooling them by supplying a cooling fluid to the extrusion surface of said spinneret or its neighborhood, whereby said extrudates are converted into numerous separated fine fibrous streams and solidified.

5 Claims, 27 Drawing Figures

FILAMENT-LIKE FIBERS AND BUNDLES THEREOF, AND NOVEL PROCESS AND APPARATUS FOR PRODUCTION THEREOF

This application is a division of application Ser. No. 133,288, filed Mar. 24, 1980 now U.S. Pat. No. 4,355,075.

This invention relates to novel filament-like fibers composed of a thermoplastic synthetic polymer, a novel bundle of such filament-like fibers, a novel process for production thereof, and to a novel apparatus for production thereof.

A novel-filament-like fiber in accordance with this invention, in summary, is characterized by having a cross-sectional area varying in size at irregular intervals along its longitudinal direction and a coefficient of intrafilament cross-sectional area variation [CV(F)], to be defined hereinbelow, of from 0.05 to 1.0. CV(F) means that when the filament-like fiber is cut at intervals of, say, 1 mm along its longitudinal direction, the individual cross-sectional areas vary randomly at irregular intervals, and the margin of the variation statistically falls within a fixed range.

This novel filament-like fiber (or simply filament), stated in more detail, is characterized by having a noncircular cross-section which varies in size at irregular intervals along its longitudinal direction and accordingly varies in shape.

The novel bundle of filament-like fibers in accordance with this invention is characterized by the fact that the individual filament-like fibers each have the aforesaid features, and when the bundle is cut at right angles to the fiber (filament) axis, the cross-sectional areas of the individual filament-like fibers substantially differ in size from each other at random.

It has now been found in accordance with this invention that novel filament-like fibers and novel bundles of filament-like fibers can be produced by a spinning process and a spinning apparatus which are quite different from those of the prior art.

Numerous methods have heretofore been known for the production of fibrous materials from thermoplastic synthetic polymers. By the theory of production, they can be classified into those of the orifice molding type and those of the phase separation molding type. The former type comprises extruding a polymer from uniform regularly-shaped orifices provided at certain intervals in a spinneret, and cooling the extrudate while drafting it. Such a method gives fibers having a uniform and fixed cross-sectional shape based on the geometric configuration of the orifices.

The latter-mentioned phase-separating molding type is a method described, for example, in U.S. Pat. No. 3,954,928, and Van A. Wente "Industrial and Engineering Chemistry", Vol. 48, No. 8, page 1342 (1956), and U.S. Pat. No. 3,227,664. This method comprises extruding a molten mass or solution of a polymer through a circular nozzle or slit-like nozzle while performing phase separation so that a fine polymer phase is formed, by utilizing the explosive power of an inert gas mixed and dispersed in the molten polymer, or applying a high-temperature high-velocity jet stream to a molten mass or a solvent flash solution of polymer, or by other phase-separating means. According to this method, large quantitities of a nonwoven-like fibrous assembly which is of a network structure can be obtained. The fibers which form this fibrous assembly are characterized by the fact that the cross sections of the individual fibers are different from each other in shape and size.

These conventional techniques of producing a fibrous material have been commercially practiced, and served to provide the market with large quantities of fibrous materials. In view, however, of the suitability and productivity of the resulting fibrous materials for textile applications, they still pose problems to be solved. If these problems are overcome, new types of textile materials having better quality would be provided at lower costs.

For example, in the case of the orifice molding type, a first problem is that if a number of orifices are provided in a single spinneret in order to produce large quantities of a high-density fibrous assembly, the interorifice distance is decreased, and the barus effect and the melt-fracture phenomenon of the molten polymer incident to orifice extrusion cause the filament-like polymer melts extruded from the orifices to adhere to each other and to suffer such troubles as breaking. Accordingly, for industrial application, the interorifice distance can be decreased only to about 2 to 3 mm at the shortest. The number of fibers extruded from the unit area of each spinneret with such an interorifice distance is about 10 to 20 at the largest, and it is impossible to produce a high-density fibrous assembly. In this technique, the molding speed is necessarily increased in order to increase productivity, and usually molding speeds on the order of 1000 m/min. are employed.

A second problem of the orifice molding type method is that the geometrical configuration of the fibers depends upon the shape of the orifices, and therefore assumes a fixed monotonous shape. This is undesirable when the resulting product is intended for textile applications such as woven or knitted fabrics.

It is well known that the physical properties of a textile product depend not only on the properties of the substrate polymer of the fibers which constitute such a product, but also largely upon the geometrical configuration of the fibers, i.e. the shape and size of the cross-sections of the fibers. For example, the tactile hand of a product made of natural fibers depends largely on the cross-sectional shape of the fibers and the irregularity of their denier sizes. It is very difficult to obtain fibers having such irregularities from thermoplastic polymers by orifice molding. It is also very difficult to directly produce ultrafine denier fibers which have important bearing on artificial leathers or suades. Such fibers have previously been produced by forming a composite fiber from dissimilar polymers, and dissolving one of the polymers, or splitting the two polymer phases. Naturally, this entails complicated steps, and leads to expensive fibers.

In the latter-mentioned method of phase separation molding type, a fibrous assembly can be produced in a larger quantity than in the first-mentioned method if the molding is effected by using slit-like nozzles. However, the product is merely a two-dimensional bundle. The fibrous bundles obtained by this technique have irregularly-shaped fiber cross sections without exception, and the variations in the shape and size of the cross sections and the deniers of the fibers are very great so that these factors are very difficult to control. Furthermore, it is even difficult to control the average denier of the fibers. Accordingly, the range of application of this technique is naturally limited. Moreover, fibrous assemblies obtained by the method of phase separation type are distinctly network-like fibrous assemblies or assemblies of branched short fibers, and the fiber length between the bonded points of the network structure or the branches is, for example, several millimeters to several centimeters. Thus, the aforesaid method of phase separation type cannot afford a fibrous assembly in which the distance between the bonded points of the individual fibers is, for example, at least 30 cm, preferably at least 50 cm, on an average and which therefore has the function of an assembly of numerous filaments.

It is a first object and advantage of this invention to provide new types of fibers and fiber bundles which have previously been unobtainable by conventional methods of producing fibrous materials from thermoplastic synthetic polymers.

A second object and advantage of this invention is to provide fibers having a cross-sectional shape similar to that of natural fibers such as silk and irregularity of the cross-sectional area in the axial direction of the fibers, and a bundle of such fibers.

A third object and advantage of this invention is to provide a new type of fibrous bundle which is suitable as a material for various textile products such as knitted fabrics, woven fabrics or nonwoven fabrics and is also useful as a material for other fiber products.

A fourth object and advantage of this invention is to provide a novel process and apparatus for producing the aforesaid novel fibers and fiber bundles.

A fifth object and advantage of this invention is to provide a novel process (spinning process) and a novel apparatus (spinning apparatus) in which, for example, 100 to 600 or more filament-like fibers can be manufactured per $cm^2$ of the polymer extrusion surface of a spinneret.

A sixth object and advantage of this invention is to provide a process and an apparatus by which fibers and the bundles thereof can be produced easily at low cost by using thermoplastic polymers having a very high melt viscosity such as polycarbonate or thermoplastic polymers exhibiting a complex viscoelastic behavior, such as polyester elastomers, polyurethane elastomers or polyolefin elastomers. the commercial production of fibers from these polymers having been previously considered difficult or practically impossible.

Other objects of this invention will become apparent from the following description.

The present invention is described below in more detail taken partly in conjunction with the accompanying drawings in which:

FIG. *2a* is a schematic enlarged sectional view of a plain weave mesh spinneret used in the second spinning embodiment of this invention, FIG. *2b* is a schematic enlarged top plane view of the plain weave mesh spinneret shown in FIG. *2a;*

Figure 4:
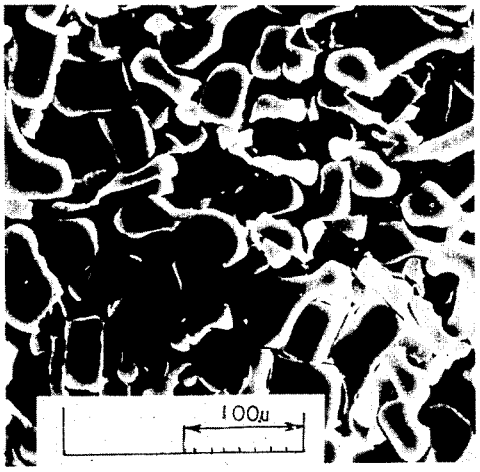
Figure 5:
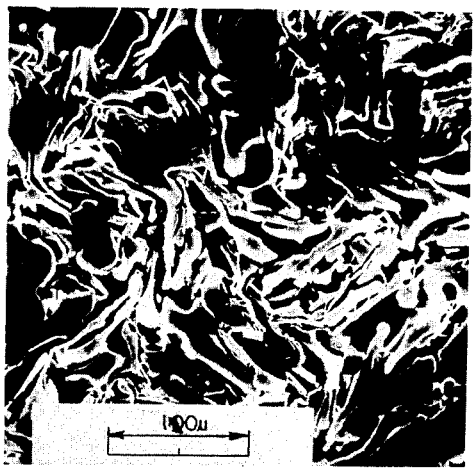
Figure 7:
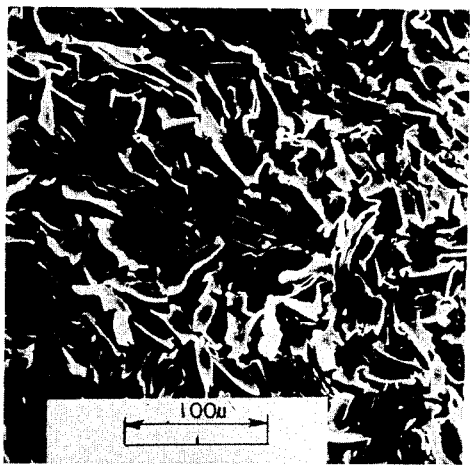
Figure 6:
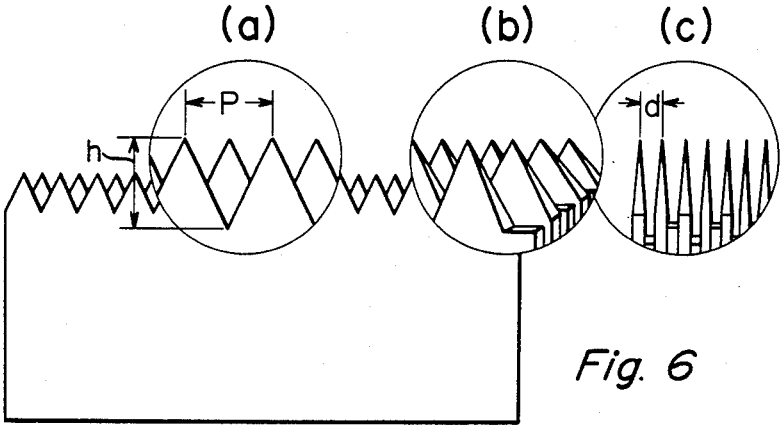
Figure 8:
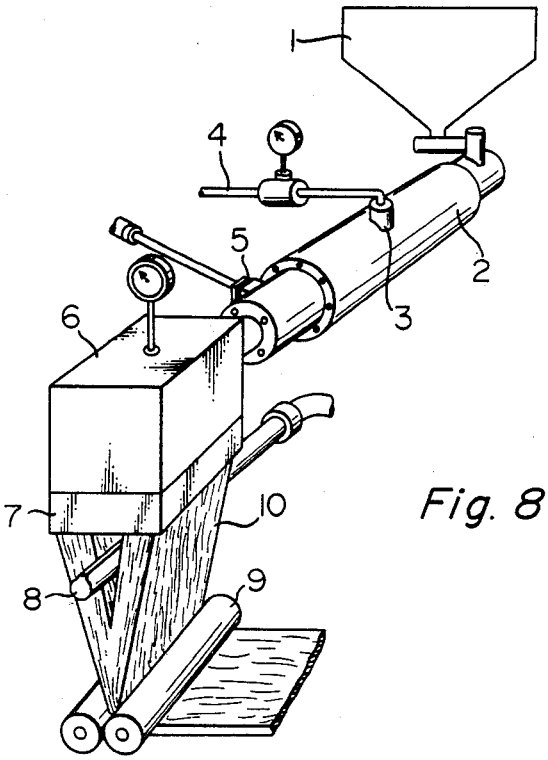
Figure 9:
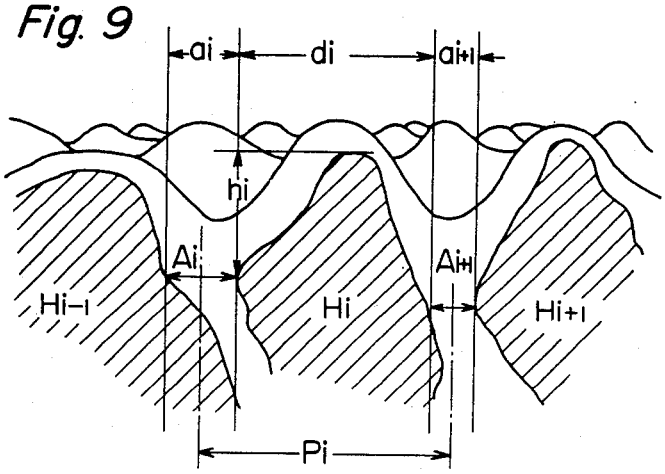
Figure 13:
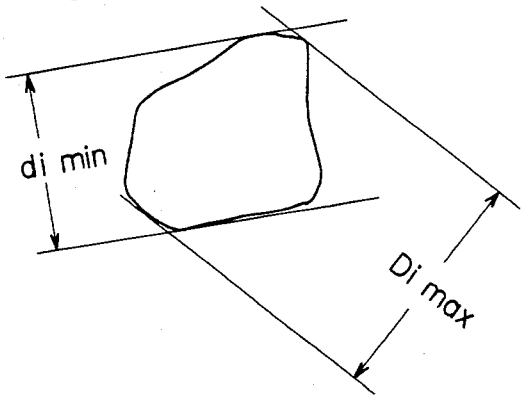
Figure 10:
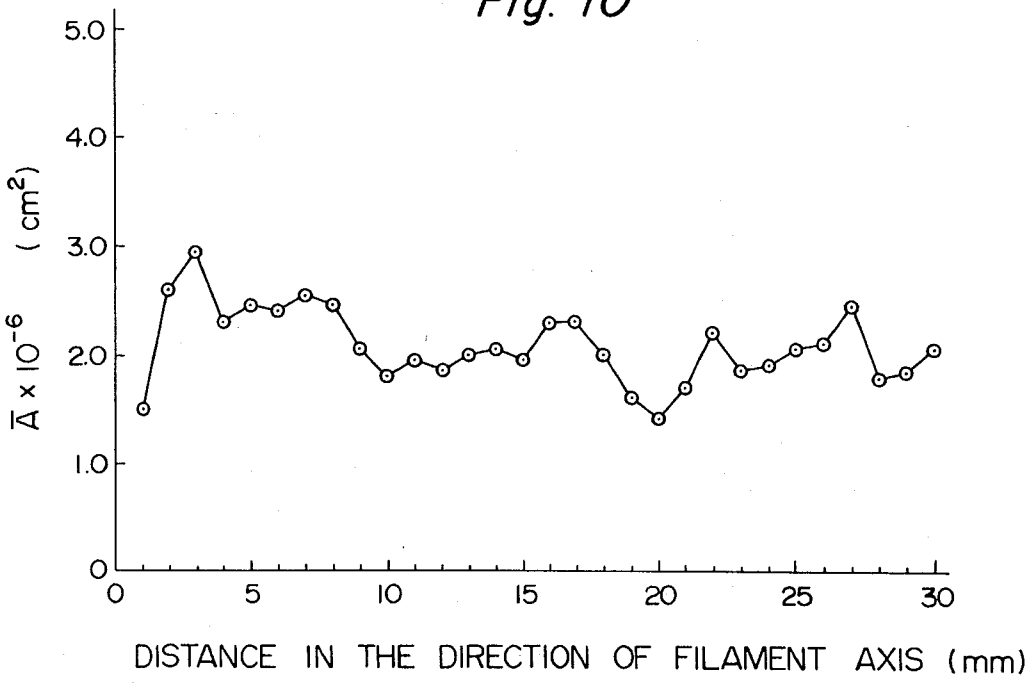
Figure 11:
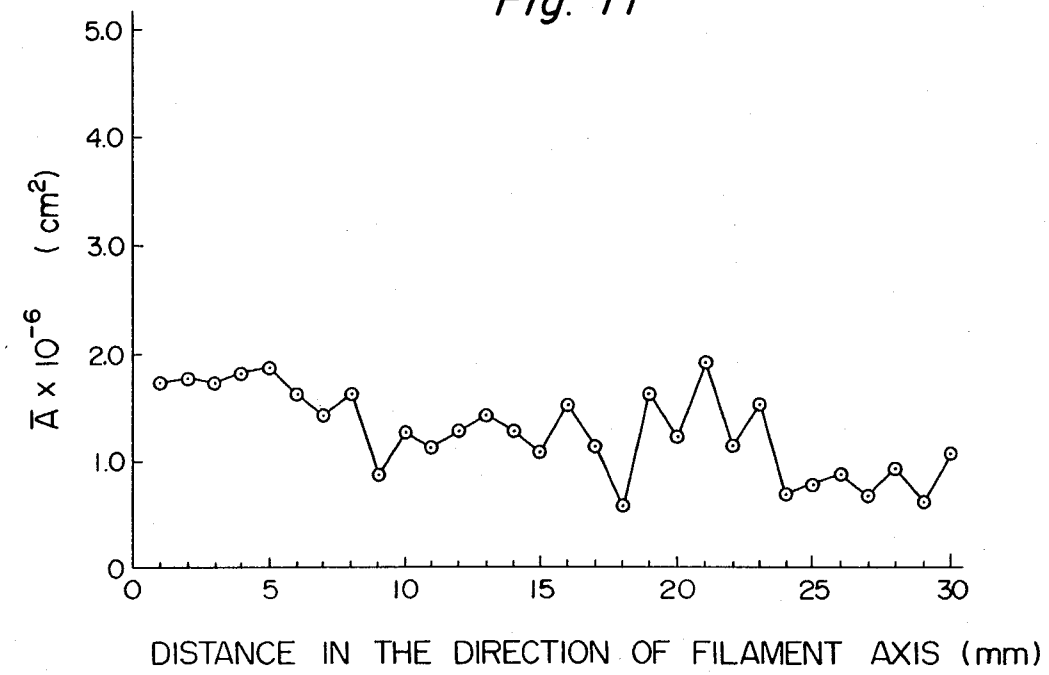
Figure 12A:
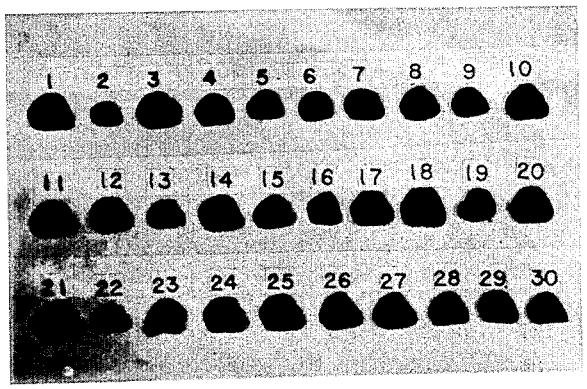
Figure 12B:
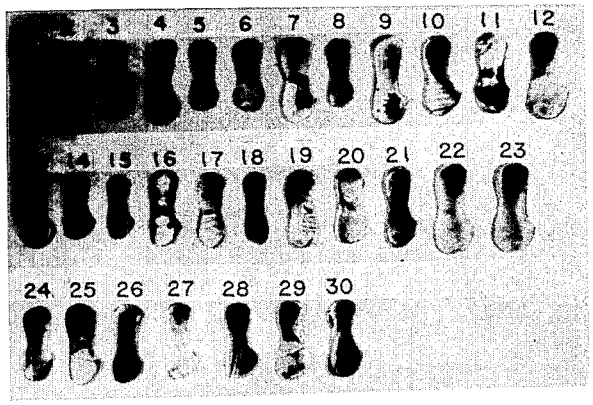
Figure 14:
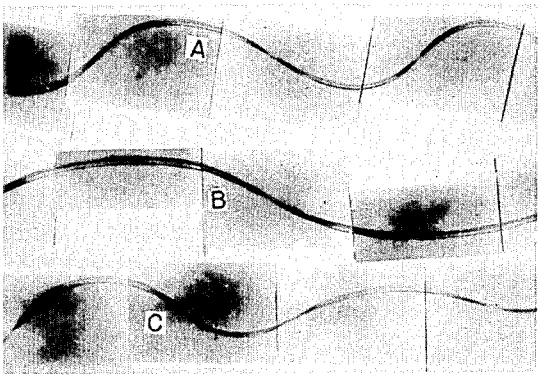
Figure 15:
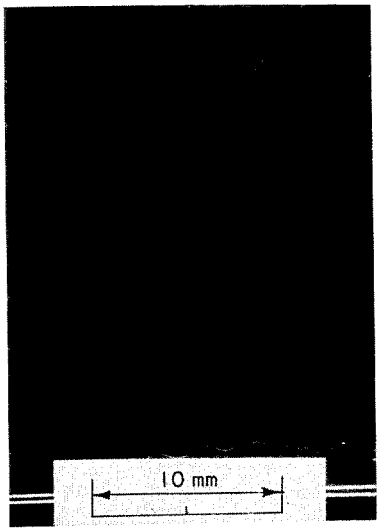
Figure 16:
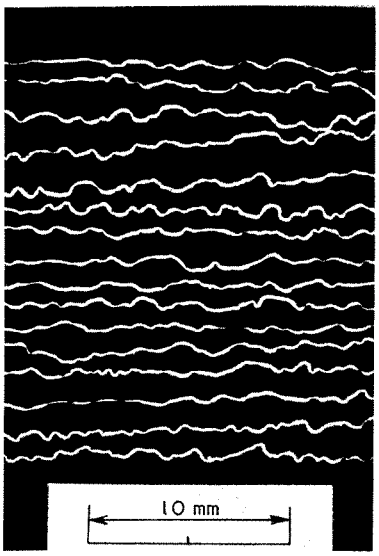
Figure 17:
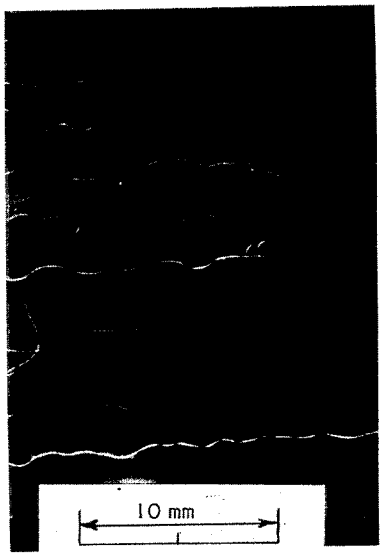
Figure 18A:
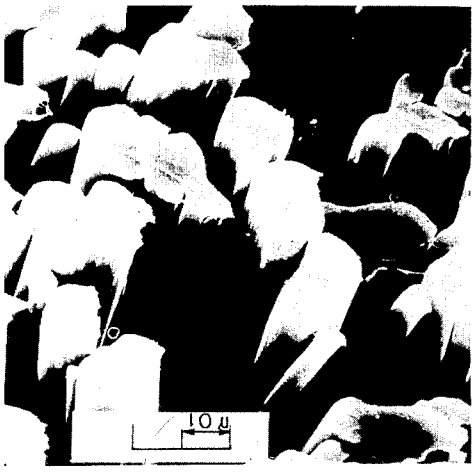
Figure 18B:
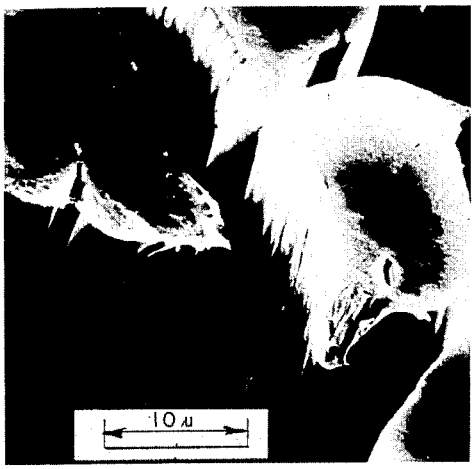
Figure 19:
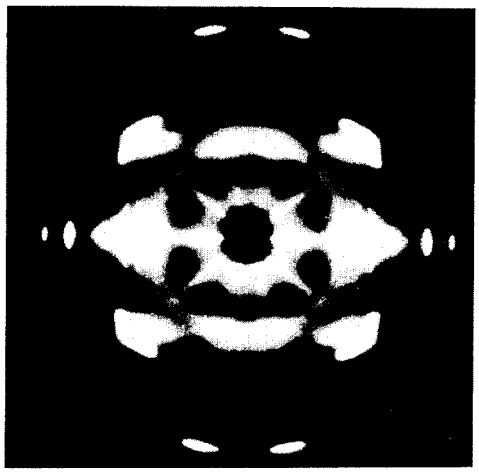
Figure 20:
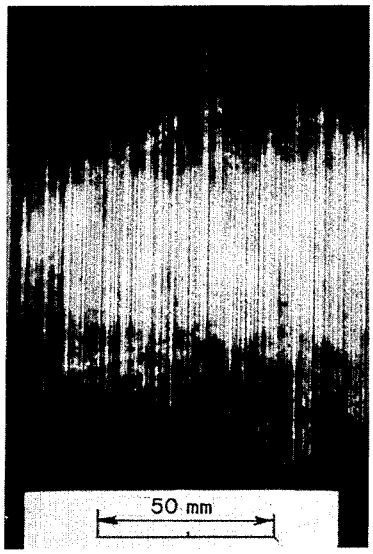
Figure 21:
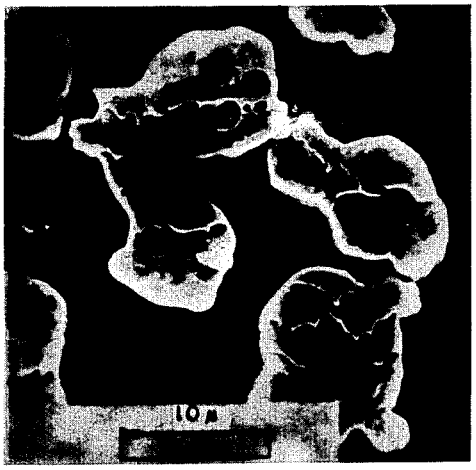

FIG. *2c* is a schematic enlarged view showing the "island-and-sea" configuration of the spinneret surface in which the polymer melts oozing out from adjacent openings in the plain weave mesh spinneret get together, and those parts of the spinneret which are above the surface of the polymer melt form islands;

FIG. *3a* is a scanning electron microphotograph of a cross section taken at an arbitrary point of the bundle of filament-like fibers obtained in Example 2 of the present application;

FIG. *3b* is a scanning electron microphotograph of a cross section taken at an arbitrary point of the bundle of filament-like fibers obtained in Example 3 of the present application;

FIG. 4 is a scanning electron microphotograph of the cross section taken at an arbitrary point of the bundle of filament-like fibers obtained in Example 5 which falls within the fourth spinning embodiment of the present invention;

FIG. 5 is a scanning electron microphotograph of a cross section taken at an arbitrary point of the bundle of filament-like fibers obtained in Example 6 of the present application;

FIG. 6 is a view illustrating a sawtooth-like stacked spinneret used in the sixth spinning embodiment of this invention;

FIG. 7 is a scanning electron microphotograph of a cross section taken at an arbitrary point of the bundle of filament-like fibers obtained in Example 7 of the present application;

FIG. 8 is a perspective view showing the outline of the production of a bundle of filament-like fibers in the molding apparatus of this invention;

FIG. 9 is a schematic enlarged view of the fiber-forming area of the spinneret in the apparatus of this invention presented for the purpose of geometrically explaining the elevations and depressions of the surface of the fiber-forming area;

FIG. 10 is a graph showing a variation in the size of cross sections, taken at 1 mm intervals in the direction of the filament axis, of one filament arbitrarily selected from undrawn filament-like fibers of the bundle obtained in Example 3;

FIG. 11 is a graph showing a variation in the size of cross sections, taken at 1 mm intervals along the direction of the filament axis, of one filament arbitrarily selected from the drawn filament-like fibers in the bundle obtained by drawing the bundle referred to in FIG. 10;

FIG. 12*a* is an optical microphotograph of the sections, taken at 1 mm intervals in the axial direction of the filament, of one filament arbitrarily selected from the bundle of filament-like fibers obtained in Example 2;

FIG. 12*b* is an optical microphotograph of the cross sections, taken at 1 mm intervals in the axial direction of filament, of one filament arbitrarily selected from the bundle of filament-like fibers obtained in Example 10;

FIG. 13 is a view illustrating the manner of measuring the irregular shape factor of a fiber cross section as defined hereinbelow;

FIG. 14 is a continuous optical microphotograph showing the crimped state in a 4 mm length of one undrawn filament selected from each of the bundles of filament-like fibers obtained in Examples 10, 3, and 14, respectively;

FIG. 15 is an enlarged photograph showing the crimped state of undrawn filaments in the bundle of filament-like fibers obtained in Example 10;

FIG. 16 is an enlarged photograph showing the crimped state of the bundle of filament-like fibers obtained in Example 13 after boiling water treatment;

FIG. 17 is an enlarged photograph showing the crimped state of the drawn bundle of filament-like fibers obtained in Example 10 after boiling water treatment;

FIGS. 18*a* and 18*b* are scanning electron microphotographs of the perpendicularly cut surfaces of the bundle of filament-like fibers obtained in Example 28 taken at an angle of 45° to the filament axis, FIG. 19 is a wide-angle X-ray diffraction pattern of the bundle of a filament-like fibers obtained in Example 3;

FIG. 20 is a photograph of the bundle of filament-like fibers obtained in Example 3 under spinning tension; and FIG. 21 is a scanning electron microphotograph of the section, taken at any arbitrary point, of the bundle of filament-like fibers obtained in Example 30.

Figure 22:
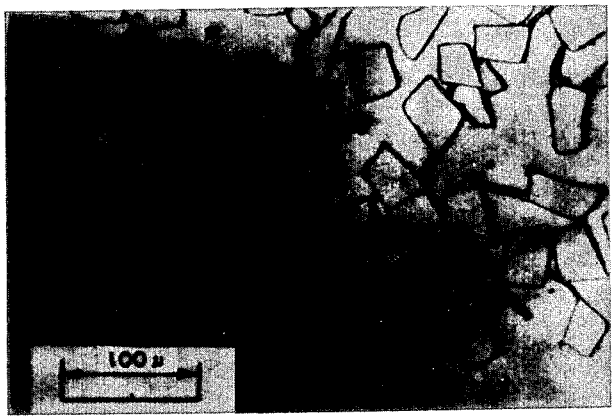

FIG. 22 is an optical microphotograph of the cross section with whiskers of the fiber bundle obtained in Example 31.

MANUFACTURING APPARATUS AND PROCESS

An apparatus and a process suitable for the production of a bundle of filament-like fibers in accordance with this invention are first described.

The bundle of filament-like fibers in accordance with this invention can be typically manufactured by using a spinneret which is characterized by having numerous small openings for extruding a melt of a thermoplastic synthetic polymer on its extruding side such that discontinuous elevations (hills) are provided between adjacent small openings, and the melt extruded from one opening can move to and from the melt extruded from another opening adjacent thereto or vice versa through a small opening or a depression (valley) existing between said elevations.

The process in accordance with this invention, more specifically stated, is a process for producing a bundle of filament-like fibers by extruding a melt of a thermoplastic synthetic polymer through a spinneret having numerous small openings, which comprises extruding said melt from said spinneret, said spinneret having such a structure that discontinuous elevations (hills) are provided between adjacent small openings on the extruding side of the spinneret, and the melt extruded from one opening can move to and from the melt extruded from another opening adjacent thereto or vice versa through a small opening or a depression (valley) exsisting between said elevations; and taking up the extrudates from the small openings while cooling them by supplying a cooling fluid to the extrusion surface of said spinneret or to its neighborhood, whereby said extrudates are converted into numerous separated fine fibrous streams and solidified.

As stated above, the process of this invention is fundamentally different from those processes which involve extruding a plastic melt from a conventional spinneret having a flat extrusion surface and regularly aligned orifices.

The present inventors planned to develop a process for manufacturing more filaments per unit area (e.g., 1 $cm^2$) of a spinneret than in conventional processes, and attempted to provide orifices in a spinneret at a higher density than in the prior art and to extrude a melt of a thermoplastic polymer from these orifices. One attempt consisted of extruding a molten polymer (e.g., a melt of crystalline polypropylene) using a spinneret having 1000 orifices having a diameter of 0.5 mm which are aligned at equal pitch intervals of 1 mm (10 in the longitudinal direction and 100 in the transverse direction). It was found that under ordinary spinning conditions, the filament-like polymer extrudates from these orifices melt-adhered to each other because of the barus effect or the bending phenomenon, and the fibers could not be produced.

Then, the present inventors attempted to quench in the aforesaid method the extrusion surface of the spinneret or a space below it so as to rapidly solidify the polymer extrudates from the orifices and to obtain fibers. It was found however that because the extrusion surfaces of the spinneret was overcooled, melt fracture occurred at many points to break the filaments at a number of orifices, and it was impossible to perform the spinning operation continuously and stably.

Figure 1:
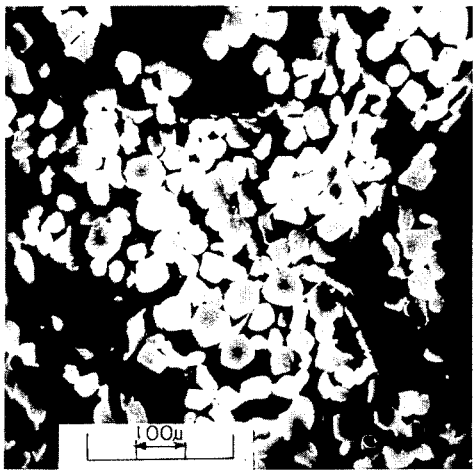
FIG. 1 is a scanning electron microphotograph of a cross section taken at an arbitrary point of the bundle of filament-like fibers obtained in Example 1 of the present application.

The present inventors then provided grooves of V-shaped cross section (width about 0.7 mm, depth about 0.7 mm) on the polymer extruding surface of the above spinneret so that they crossed the orifices at an angle of about 45° and about 135° to the orifice arrangement, and extruded a polymer melt using the resulting spinneret having elevations (hills) and depressions (valleys) between the orifices (small openings) on the extrusion surface of the spinneret. In the initial stage, the polymer melt flowed so as to cover the entire extrusion surface of the spinneret. When the polymer extrudates were taken up while properly quenching the extrusion surface of the spinneret and its vicinity by blowing an air stream, the melt was gradually divided, and the elevations of the spinneret gradually appeared in the form of islands on the surface of the melt. Thus, numerous filament-like fibers could be taken up continuously and stably. (The aforesaid spinning embodiment is referred to hereinbelow as a first spinning embodiment of the invention.) Detailed conditions for the first spinning embodiment are described in Example 1 to be given hereinbelow. A photograph of the cross section of a part of the resulting filament-like fiber bundle is shown in FIG. 1 (to be further described below).

Figure 2A:
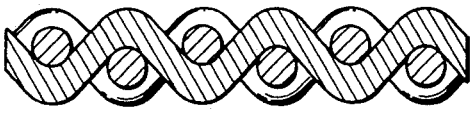
Figure 2B:
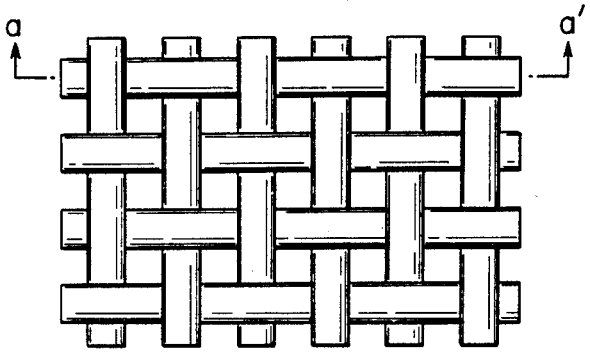
Figure 2C:
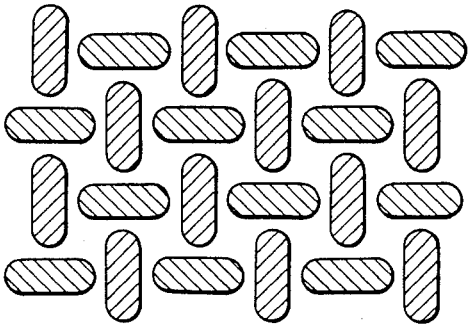

After succeeding in the spinning of fibers in a high density by the first spinning embodiment, the present inventors tried to spin a polymer melt through a plain weave wire mesh of the type shown in FIG. 2 as described in Example 2 to be given hereinbelow. Specifically, the polymer melt was extruded in the same way as in Example 1 from a plain weave wire mesh made of stainless steel wires having a diameter of about 0.21 mm and having a width of 2 cm and a length of 16 cm (area 32 $cm^2$) with an open area of about 31% and containing about 590 meshes per $cm^2$. As stated in Example 1, the polymer melt first flowed in such a way as to cover the entire wire mesh. While the polymer extrusion surface of the wire mesh and its vicinity were properly cooled with an air stream, the melt was gradually divided, and elevations (hills) of the wire mesh appeared in the form of islands as shown by hatched areas in FIG. 2*c*. Thus, the polymer melt was converted to numerous separated fine fibrous streams and solidified. Numerous filament-like fibers could therefore be taken up continuously and stably. This spinning embodiment is referred to hereinbelow as a second spinning embodiment of the invention.

Figure 3A:
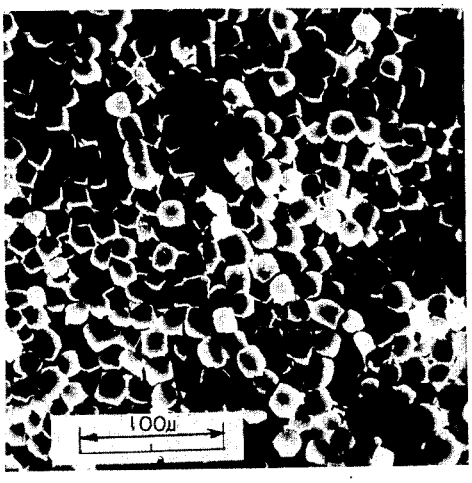

FIG. 3*a* shows the cross section of a part of the fiber bundle obtained by this embodiment. The wire mesh may be of any woven structure. For example, if the spinning of Example 2 is carried out using a wire mesh of twill weave, there can be obtained a bundle of filament-like fibers having a special cross-sectional shape shown in FIG. 3*b*.

Furthermore, as shown in Example 4 to be given hereinbelow, the present inventors extruded a polymer melt using a spinneret (width about 30 mm, length about 50 mm) composed of a plain weave wire mesh (wire cloth) made of stainless steel wires having a diameter of about 0.38 mm and having an open area of about 46% and containing about 96 meshes per $cm^2$ and tapered pins protruding at every other mesh in a zigzag form to a height of about 2 mm. In the initial stage, the melt flowed so as to cover the entire surface of the tips of many pins in the wire mesh. When the extrudate was taken up while cooling the polymer extrusion surface of the wire mesh and its vicinity by blowing an air, the melt was first taken up as fine streams from the tips of the pins, and after a while, it was taken up as divided fine streams from the depressed areas among the pins and cooled to form a bundle of numerous filament-like fibers stably and continuously. In this case, the numerous pins protruded in the form of islands in the sea of the polymer melt, and in the narrow areas between adjacent islands, the melt was taken up directly from the sea as numerous divided fibers. It was quite unexpected that numerous divided filament-like fibers could be continuously formed at high density directly from the sea area. The above embodiment is referred to as a third spinning embodiment of the invention.

The present inventors further tried to perform high-density spinning of a polymer melt using various other types of spinnerets. These embodiments of using different spinnerets are described in detail in Examples to be given hereinbelow. Typical examples are summarized below.

Fourth spinning embodiment

A process for producing an assembly of numerous filament-like fibers, which involves using as a spinneret a porous plate-like structure in which numerous tiny metallic balls are densely filled and arranged at least in its surface layer and cemented by sintering, and extruding a polymer melt through the pores of the porous plate-like structure (see Example 5 to be given hereinbelow). FIG. 4 shows the cross-section of a part of the filament-like fiber bundle obtained by this embodiment.

Fifth spinning embodiment

A process for producing an assembly of numerous filament-like fibers, which involves using as a spinneret a structure obtained by densely stacking many plain weave wire meshes having a diameter of about 0.2 mm and a mesh ratio of about 30% in the longitudinal direction, and extruding a polymer melt in a direction parallel to the stacked surfaces of the meshes, as shown in Example 6. In this embodiment, the wires lying in the longitudinal direction which make up the wire meshes form elevations (hills) between small openings as do the many pins in the third spinning embodiment.

FIG. 5 shows the cross-section of a part of the bundle of filament-like fibers formed by this embodiment.

Sixth spinning embodiment

A process for producing an assembly of numerous filament-like fibers, which involves using as a spinneret a structure obtained by longitudinally stacking many metallic plates having saw-like teeth at their tip portions at fixed minute intervals as shown in FIG. 6, and extruding a polymer melt in a direction parallel to the surfaces of the many metallic plates using the sawtooth-like sections as an extrusion section, as shown in Example 7 given hereinbelow. FIG. 7 shows the cross section of a part of the bundle of filament-like fibers obtained by this embodiment.

As shown in the first to sixth spinning embodiments, according to this invention, a bundle of very many filament-like fibers per unit area of spinneret can be produced by extruding a melt of a thermoplastic synthetic polymer through a spinneret having numerous small openings, said spinneret having such a structure that discontinuous elevations (hills) are provided between adjacent small openings on the extruding side of the spinneret, and the melt extruded from one opening can move to and from the melt extruded from another opening adjacent thereto or vice versa through a small opening or a depression (valley) existing between said elevations; and taking up the extrudates from the small openings while cooling them by supplying a cooling fluid to the extrusion surface of said spinneret or to its neighborhood, whereby said extrudates are converted into numerous separated fine fibrous streams and solidified.

Furthermore, as is clear from the third spinning embodiment (using numerous needle-like members as elevations), the fifth spinning embodiment (using the wires of the wire meshes as elevations), the sixth spinning embodiments (using sawtooth-like members as elevations), etc., according to this invention, a bundle of filament-like fibers can be continuously produced by extruding a melt of a thermoplastic synthetic polymer from a spinneret such that said melt forms a continuous phase (sea) on the extruding side of the spinneret and many isolated discontinuous non-polymer phase (islands) are formed in the sea by numerous projecting members protruding on the extrusion side, and taking up the melt from said continuous phase (sea) in the form of numerous fibrous fine streams while cooling the melt extrusion surface of the spinneret and its vicinity with a cooling fluid thereby to solidify the fine fibrous streams.

According to this invention, there can be continuously and stably formed a bundle of numerous filament-like fibers which, for example, contain per $cm^2$ of spinneret about 50 to about 150 fibers having an average size of about 30 to about 100 denier, or about 100 to about 600 fibers having an average size of about 1 to about 5 denier, or about 600 to 1,500 or more fibers having an average size of less than about 1 denier.

With a conventional melt-spinning process, it is practically impossible to make at least 30, especially at least 50, filament-like fibers per $cm^2$ of the fiber-forming area of a spinneret continuously and stably. In view of this fact, the process for producing fibers in accordance with this invention is believed to be quite innovative.

Furthermore, the process of this invention can afford filament-like fiber bundles in which the individual fibers have an average size ranging from fine deniers of, say, 0.01 denier, preferably 0.05 denier, to heavy deniers of, for example, 300 denier, preferably 150 denier, especially preferably 100 denier.

In the process of this invention, the fiber-forming area of the spinneret, i.e. the area where fibers are substantially formed, is desirably of a tape-like shape, especially a rectangular shape, in order to cool the polymer extrudate from the small openings of the spinneret uniformly and efficiently. Such a rectangular area desirably has a width of not more than about 6 cm, especially not more than about 5 cm, and any desired length. Preferably, the melt of polymer extruded is cooled by blowing an air stream against the polymer extrusion surface of the spinneret through a slit-like opening substantially parallel to the longitudinal direction of the rectangular area so that in the vicinity of the extrusion surface, the air stream flows parallel to the extrusion surface.

As such a cooling fluid, an air stream at room temperature is used as a typical example, and advantageously, its flow velocity immediately after passing through the fiber bundle at a position 5 mm apart from the extrusion surface (the tip surface of hills) of the spinneret is about 4 to about 40 meters/sec., preferably about 6 to about 30 meters/sec.

According to this invention, it is possible to produce a filament-like fiber bundle having a denier of 3,000 to 120,000 denier, preferably 5,000 to 100,000 denier, per 20 $cm^2$ of the rectangular fiber-forming area (width 2 cm×length 10 cm), for example. By increasing the size of the rectangular shape, especially its length, a filament-like fiber bundle having a large denier can be continuously produced in a single process. The length of the rectangular fiber-forming area in actual practice may be of any degree of magnitude which does not cause inconvenience to actual operations. For example, it could be 2 to 3 meters or even more.

The amount of polymer extruded per $cm^2$ of the fiber-forming area is preferably 0.1 to 10 g/min., especially 0.2 to 7 g/min.

Any thermoplastic synthetic polymers which are fiber-forming can be used in this invention. Advantageously, there may be used thermoplastic synthetic polymers which when melted at a temperature (absolute temperature, °K.) 1.1 times as high as their melting point in °K., have a melt viscosity of 200 to 30,000 poises, preferably 300 to 25,000 poises, especially preferably 500 to 15,000 poises.

The melt viscosity (poises) of a polymer denotes the viscosity of the polymer at a temperature corresponding to Tm(°K.)×1.1 where Tm is the melting point of the polymer in °K. This viscosity is measured by a flow tester method which conforms substantially to ASTM D1238-52T.

The polymers preferably have a melting point of 70° to 350° C., especially 90° to 300° C., but are not limited to this range.

The temperature ($T_o$) of the polymer extrudate forced from small openings in the extrusion side of a spinneret is calculated by the following equation (1).

$$T_o(°K.)=(5t_{-2}-2t_{-5})\cdot\tfrac{1}{3}+273 \quad (1)$$

wherein $t_{-2}$ is the temperature (°C.) actually measured of the molten polymer at a position 2 mm inwardly of the spinneret from the tip surface of an elevation of the spinneret, and $t_{-5}$ is the temperature (°C.) actually measured of the molten polymer at a position 5 mm inwardly of the spinneret from the tip surface of an elevation of the spinneret.

In the present invention, it is preferred to extrude the polymer melt from the small openings of the spinneret such that the ratio of the temperature ($T_o$) of the extruded polymer calculated from equation (1) to the melting point ($T_m$ in °K., absolute temperature) of the polymer ($T_o/T_m$) is from 0.85 to 1.25, especially from 0.9 to 1.2, above all from 0.95 to 1.15.

The suitable take-up speed ($V_L$) at which the resulting fiber bundle is taken up from the spinneret is 100 to 10,000 cm/min., especially 300 to 7,000 cm/min., above all 500 to 5,000 cm/min.

The apparent draw ratio (Da) at which the polymer melt extruded from the spinneret is drafted can be expressed by the following equation (2).

$$Da=V_L/V_o \quad (2)$$

wherein $V_L$ is the actual take-up speed of the fiber bundle (cm/min.), and $V_o$ is the average linear speed (cm/min.) of the polymer melt in the extruding direction when the polymer melt is extruded so as to cover the entire extrusion surface of the fiber-forming area of the spinneret. On the other hand, the following equation (3) can be approximately established with regard to $V_O$.

$$V_O=W/S_O\cdot\rho \quad (3)$$

wherein

W is the amount (g/min.) of the molten polymer when the molten polymer is extruded so as to cover the entire extrusion surface of the fiber-forming area of the spinneret, $S_O$ is the area ($cm^2$) of the entire extrusion surface of the fiber-forming area, and $\rho$ is the density ($g/cm^3$) of the polymer at room temperature.

Accordingly, the apparent draw ratio (Da) of the polymer melt extruded from the spinneret can be calculated in accordance with the following equation (4).

$$Da=(V_L\cdot\rho\cdot S_O)/W \quad (4)$$

It is preferred to control the draw ratio (Da) that can be calculated from the above equation (4) to a range of 10 to 10,000, especially 100 to 5,000, advantageously 200 to 4,000.

The reciprocal of the apparent draw ratio represents packing fraction ($P_f$).

$$P_f=1/Da \quad (5)$$

The packing fraction ($P_f$) represents the sum of the cross-sectional areas of the entire fibers of the fiber bundle which is formed per unit area of the fiber-forming area of the spinneret, and constitutes a measure of the density of fibers spun from the fiber-forming area, that is, high-density spinning property.

In the conventional melt spinning of polymer, the packing fraction ($P_f$) is on the order of $10^{-5}$ at most, whereas in the present invention, $P_f$ is on the order of from $10^{-4}$ to $10^{-1}$, preferably $2\times10^{-4}$ to $10^{-2}$. In this respect, too, the process of this invention clearly differs greatly from conventional melt-spinning processes for polymer.

The total denier (ΣDe) of the fiber bundle produced from the fiber-forming areas of the spinneret in accordance with this invention can be calculated in accordance with the following equation (6).

$$\Sigma De=(W/V_L)\times9\times10^5 \quad (6)$$

wherein $V_L$ and W are as defined with respect to equations (2) and (3).

The total number (N) of fibers in the fiber bundle can be calculated in accordance with the following equation (7) using the average denier ($\overline{De}$) actually measured of an arbitrarily selected part of the bundle.

$$N=(\Sigma De)/\overline{De} \quad (7)$$

The number ($\bar{n}$) of fibers per unit area ($cm^2$) of the spinneret can be calculated from the following equation (8).

$$\bar{n}=N/S_o \quad (8)$$

wherein $S_o$ is the same as in equation (3), and N is the same as defined in equation (7).

In the present invention, if the number of meshes per $cm^2$ of a plain weave wire mesh described in the second spinning embodiment (this number is expressed as the product of the number of wires in the longitudinal and transverse directions per $cm^2$) is taken as $n_{(m)}$, the aforesaid $\bar{n}$ is 0.2 $n_{(m)}$ to 0.98 $n_{(m)}$.

Likewise, in a wire mesh of twill weave, $\bar{n}$ is usually about 0.2 $n_{(m)}$ to 0.9 $n_{(m)}$.

Thus, according to this invention, by using wire meshes of various woven structures, and adjusting the type of polymer or the spinning conditions, $\bar{n}$ can be varied within the range of 0.2 $n_{(m)}$ to 0.98 $n_{(m)}$, and the size and/or shape of the cross section of each fiber can be accordingly varied.

In the first spinning embodiment of this invention, $\bar{n}$ is 0.7 $n_{(m)}$ to 0.95 $n_{(m)}$ if the number of orifices per $cm^2$ is taken as $n_{(m)}$.

In the third to sixth embodiments of this invention described above, $\bar{n}$ is 0.3 $n_{(m)2}$ to about 1 $n_{(m)}$ if the number of elevations (hills) per $cm^2$ is taken as $n_{(m)}$.

In the process of this invention, the distance over which the polymer melt as extruded from small openings in the extrusion side of the spinneret travels until it is solidified as numerous separated fine fibrous streams, i.e. the distance from the surface of the elevations of the spinneret to a point at which the fine fibrous streams have a diameter 1.1 times as large as the fixed fiber diameter, is referred to as the solidification length represented by $L_f$. In the present invention, $L_f$ is as short as less than 2 cm, advantageously less than 1 cm, while it is about 10 to 100 cm in conventional melt-spinning processes.

The distance $L_f$ can be measured, for example, by blowing a cooling stream such as a stream of dry carbon dioxide cooled to below the freezing point against a part of the surfaces of the fiber-forming areas of the spinneret in a stage wherein a bundle of filament-like fibers is being produced stably in accordance with this invention, thereby to freeze and solidify the fibrous streams of the polymer extrudates, removing the solidified fibrous streams from the spinneret, and examining them by a microscope.

In the present invention, the coefficient (k) of solidification length defined by equation (9) is preferably in the range of 10 to 500, especially 30 to 300, advantageously 50 to 200.

$$k = L_f/\sqrt{A_L} \quad (9)$$

wherein $\overline{A}_L$ is the average cross-sectional area of as-spun fibers upon solidification, and $L_f$ is the solidification length defined above.

$\overline{A}_L$ can be calculated in accordance with the following equation (10).

$$\overline{A}_L = \frac{\overline{De}}{9 \times \rho} \times 10^{-5}\ (cm^2) \quad (10)$$

wherein $\overline{De}$ is the average denier of the fibers obtained by actually measuring the denier sizes of any arbitrarily selected part of the fiber bundle, and $\rho$ is the density ($g/cm^3$) of the polymer at room temperature.

The known solidification length coefficient of conventional melt-spinning is on the order of $10^4$ to $10^5$, whereas in the present invention, the solidification length coefficient (k) is not more than 500, especially not more than 300. In view of this, the polymer melt is solidified within a very short range in the present invention, and this greatly differs from conventional melt-spinning processes.

The suitable tension (g/denier) at which the filament-like fiber bundle in this invention is taken up is 0.001 to 0.2, preferably 0.02 to 0.1 g/denier.

As is clearly appreciated from the first to sixth spinning embodiments of this invention described above, and from the relation of the number ($\bar{n}$) of fibers per unit area of the spinneret to the number of small openings or elevations [$n_{(m)}$] on the polymer extruding side of the spinneret, the polymer melt in one small opening or continuous phase (sea) can always communicate with the melt in another small opening or sea adjacent thereto, and the polymer melt is taken up from such small openings or seas while being divided into fine fibrous streams. Hence, when a fine fibrous stream taken up from one small opening or sea breaks, it immediately gets together with a fine fibrous stream taken up from the adjacent small opening or sea, and is fiberized. Furthermore, the fine stream formed as a result of association again separates to form separated filament-like fibers. In this way, by the cooperative action between fine streams of the polymer melt, a very great number of filament-like fibers can be stably and continuously produced in bundle form from the fiber-forming areas if this process is viewed as a whole.

As described hereinabove, in the present invention, the aforesaid filament-like fiber bundle can be produced by using a spinneret characterized by having numerous small openings for extruding a melt of a thermoplastic synthetic polymer on its extruding side such that discontinuous elevations (hills) are provided between adjacent small openings, and the melt extruded from one opening can move to and from the melt extruded from another opening adjacent thereto or vice versa through a small opening or a depression (valley) existing between said elevations.

From another viewpoint, the process of this invention may be regarded as a melt-spinning process using a spinneret whose surface has fine elevations and depressions. According to this spinning process, fine elevations and depressions of polymer melt are stably formed on the surface of the polymer melt, and while inhibiting the adhesion of the elevations of the polymer melt to each other, fibers are spun mainly from the elevations of the polymer melt.

It is important therefore that the apparatus for forming the fiber bundle in accordance with this invention should have:

(a) a spinneret capable of forming a polymer melt surface having fine elevations and depressions, (b) a means for quenching the surface of the spinneret so as to form the fine elevations and depressions on the surface of the polymer melt, and (c) means for taking up the extruded polymer melt from the elevations of the surface of the polymer melt.

Advantageously, there is used in accordance with this invention an apparatus for producing a bundle of numerous filament-like fibers comprising a spinneret having the aforesaid structure in which the average distance ($\bar{p}$) between extrusion openings for the polymer melt on the surface of its fiber-forming area is in the range of 0.03 to 4 mm. Especially advantageously, there is used an apparatus which comprises an area for molding a molten polymer having an extrusion surface with fine elevations and depressions and numerous extrusion openings for polymer which have (1) an average distance ($\bar{p}$) between extrusion openings of 0.03 to 4 mm, (2) an average hill height ($\bar{n}$) of 0.01 to 3.0 mm, (3) an average hill width ($\bar{d}$) of 0.02 to 1.5 mm, and (4) a ratio of the average hill height ($\bar{h}$) to the average hill width ($\bar{d}$), [($\bar{h}$)/($\bar{d}$)], of from 0.3 to 5.0; means for cooling said extrusion surface, and means for taking up the resulting fiber bundle.

The fiber-forming area, average distance ($\bar{p}$) between extrusion opening, average hill height ($\bar{h}$), average hill width ($\bar{d}$) and extrusion openings as referred to above the defined below.

The average distance ($\bar{p}$) between extrusion openings, average hill height ($\bar{h}$), average hill width ($\bar{d}$), etc. defined in this invention are determined on the basis of the concept of geometrical probability theory. Where the shape of the surface of the fiber-forming area is geometrically evident, they can be calculated mathematically by the definitions and techniques of integral geometry.

For example, with regard to the fiber-forming area of a spinneret in which sintered ball-like objects with a radius of r are mostly closely packed, the following values are obtained theoretically.

$$\bar{p} = \sqrt{3}\ r,\ \bar{n} = \frac{\pi}{4}\ r,\ \bar{d} = \frac{\pi}{2}\ r.$$

Thus, these parameters can be theoretically determined in a spinneret whose surface is composed of an aggregation of microscopic uniform geometrically shaped segments. Where the spinneret has a microscopically nonuniform surface shape, $\bar{p}$, $\bar{h}$, and $\bar{d}$ can be determined by cutting the spinneret along some perpendicular sections, or taking the profile of the surface of the spinneret by an easily cuttable material and cutting the material in the same manner, and actually measuring the distances between extrusion openings, hill heights, and hill widths. In measurement, an original point is set at the center of the fiber-forming area, and six sections are taken around the original point at every 30° and measured. From this, approximate values of $\bar{p}$, $\bar{h}$, and $\bar{d}$ can be determined. For practical purposes, this technique is sufficient.

The fiber-forming area, as used in this application, denotes that area of a spinneret in which a fiber bundle having a substantially uniform density is formed. The spinneret is, for example, the one shown at 7 in FIG. 8 for preparing a fiber bundle by extruding a molten polymer from a spinning head 6.

The polymer extrusion opening in the molding apparatus of this invention denotes the first visible minute flow path among polymer extruding and flowing paths of a spinneret, which can be detected when the fiber-forming area of the spinneret is cut by the plane perpendicular to its levelled surface (microscopically smooth phantom surface taken by levelling the surface with fine elevations and depressions) (the cut section thus obtained will be referred to hereinbelow simply as the cut section of the fiber-forming area), and the cut section is viewed from the extruding side of the surface of the fiber-forming area.

FIG. 9 shows a schematic enlarged view of an arbitrarily selected cut section of the general fiber-forming area in this invention. In FIG. 9, $A_i$ and $A_{i+1}$ represents the extrusion openings. The distance between the center lines of adjoining extrusion openings $A_i$ and $A_{i+1}$ is referred to as the distance $P_i$ between the extrusion openings. The average of $P_i$ values in all cut sections is defined as the average distance $\bar{p}$ between extrusion openings.

That portion of a cut section located on the right side of, and adjacent to, a given extrusion $A_i$ in a given cut section which lies on the extruding side of the surface of the fiber-forming area from the $A_i$ portion is termed hill Hi annexed to $A_i$. The distance $h_i$ from the peak of hill Hi to the levelled surface of Ai is referred to as the height of hill Hi. The average of $h_i$ values in all cut sections is defined as the average hill height $\bar{h}$.

The width of the hill $H_i$ interposed between the extrusion openings $A_i$ and $A_{i+1}$ which is parallel to the levelled surface of the spinneret $H_i$ is referred to as hill width $d_i$. The average of $d_i$ values in all cut sections is defined as average hill width $\bar{d}$.

In accordance with the above definitions, the molding apparatus in accordance with this invention is advantageously such that the spinneret of its polymer molding area, i.e. fiber-forming area, has a surface with fine elevations and depressions and numerous polymer extrusion openings which meet the following requirements.

(1) The average distance ($\bar{p}$) between extrusion openings is in the range of 0.03 to 4 mm, preferably 0.03 to 1.5 mm, especially preferably 0.06 to 1.0 mm.

(2) The average hill height ($\bar{h}$) is in the range of 0.01 to 3.0 mm, preferably 0.02 to 1.0 mm.

(3) The average hill width ($\bar{d}$) is in the range of 0.02 to 1.5 mm, preferably 0.04 to 1.0 mm.

(4) The ratio of the average hill height ($\bar{h}$) to the average hill width ($\bar{d}$), $\bar{h}/\bar{d}$, is in the range of from 0.3 to 5.0, preferably from 0.4 to 3.0.

More advantageously, in addition to prescribing the values of $\bar{p}$, $\bar{h}$, $\bar{d}$ and $\bar{h}/\bar{d}$ within the aforesaid ranges (1) to (4), the structure of the spinneret surface is prescribed so that the value $(\bar{p}-\bar{d})/\bar{p}$ is in the range from 0.02 to 0.8, preferably from 0.05 to 0.7. The value $(\bar{p}-\bar{d})/\bar{p}$, represents the ratio of the area of an extrusion opening within the fiber-forming area.

A bundle of filament-like fibers can be formed by extruding a molten polymer from extrusion openings having such minute elevations and depressions on the surface, cooling the extrusion surface, and taking up the extrudates under proper conditions.

According to this invention, a number of thermoplastic synthetic polymers exemplified below can be used to produce the bundle of filament-like fibers.

(i) Olefinic or vinyl-type polymers

Polyethylene, polypropylene, polybutylene, polystyrene, polyvinyl chloride, polyvinyl acetate, polyacrylonitrile, poly(acrylates), or copolymers of these with each other.

(ii) Polyamides

Poly-ε-caprolactam, polyhexamethylene adipamide, and polyhexamethylene sebacamide.

(iii) Polyesters

Advantageous polyesters are those derived from aromatic dicarboxylic acids such as phthalic acid, isophthalic acid, terephthalic acid, diphenyldicarboxylic acid or naphthalenedicarboxylic acid, aliphatic dicarboxylic acid such as adipic acid, sebacic acid or decanedicarboxylic acid or alicyclic dicarboxylic acids such as hexahydroterephthalic acid as a dibasic acid component and aliphatic, alicyclic or aromatic glycols such as ethylene glycol, propylene glycol, trimethylene glycol, tetramethylene glycol, decamethylene glycol, diethylene glycol, 2,2-dimethylpropanediol, hexahydroxylylene glycol or xylylene glycol as a glycol component. The dibasic acids or glycols may be used singly or as a mixture of two or more. Examples of preferred polyesters are polyethylene terephthalate, polytetramethylene terephthalate, polytrimethylene terephthalate, and the polyester elastomers described in U.S. Pat. No. 3,763,109, 3,023,192 3,651,014 and 3,766,146.

(iv) Other polymers

Polycarbonates derived from various bisphenols; polyacetals; and various polyurethanes, polyfluoroethylenes and copolyfluoroethylenes.

The above-exemplified thermoplastic synthetic polymers may be used singly or as a mixture of two or more. Plasticizers, viscosity increasing agents, etc. may be added to the polymers in order to increase their plasticity or melt viscosity. The polymers may also include conventional textile additives such as light stabilizers, pigments, heat stabilizers, fire retardants, lubricants and delusterants.

The polymers are not limited to linear polymers, and polymers having a partially crosslinked three-dimensional structure may also be used so long as their thermoplasticity is retained.

In the production of the bundle of filament-like fibers in accordance with this invention, a soluble liquid medium may be incorporated in a small amount in molten polymer. Or an inert gas or a gas-generating agent may be added. When the process of this invention is practiced using a polymer to which a volatile liquid medium, an inert gas, or a gas generating agent has been added, the liquid medium or gas explosively gives foams on the surface of the spinneret, and a fiber bundle having a more attenuated fiber cross-sectional structure can be formed. Suitable gases for this purpose include nitrogen, carbon dioxide gas, argon, and helium.

According to the process of this invention, not only those polymers which have been used heretofore in melt-spinning, such as polyethylene terephthalate, poly-ε-caprolactam, polyhexamethylene adipamide, polyethylene, polypropylene, polystyrene or polytetramethylene terephthalate can be advantageously used, but also polycarbonates, polyester elastomers which have been considered difficult to melt-spin industrially can be easily fiberized without any trouble. According to the process of this invention, both crystalline and non-crystalline polymers can be formed into a fiber bundle.

BUNDLE OF FILAMENT-LIKE FIBERS OF THIS INVENTION

According to the present invention described hereinabove, a bundle of filament-like fibers in which the average distance between bonded points of the filaments is from about 30 cm to even several tens of meters can be produced continuously by a stable operation by adjusting the type of polymer, the structure of the spinneret, the spinning conditions, etc.

The filament-like fibers of this fibrous bundle differ from any conventionally known artificial filaments or fibers in that (A) each filament has a cross-sectional area varying in size at irregular intervals along its longitudinal direction, and (B) its coefficient of intrafilament cross-sectional area variation [CV(F)] is in the range of 0.05 to 1.0.

The coefficient of intrafilament cross-sectional area variation [CV(F)], as referred to herein, denotes a variation in the denier size of each filament in its longitudinal direction (axial direction), and can be determined as follows:

Any 3 cm-length is selected in a given filament of the fiber bundle, and the sizes of its cross-sectional areas taken at 1 mm intervals were measured by using a microscope. Then, the average ($\overline{A}$) of the sizes of the thirty cross-sectional areas, and the standard deviation ($\sigma_A$) of the thirty cross-sectional areas are calculated, and CV(F) can be computed in accordance with the following equation (11).

$$CV(F)=(\sigma A)/\overline{A} \quad (11)$$

Each of the filaments which constitutes the fiber bundle of this invention suitably has a CV(F) of 0.05 to 1.0, especially 0.08 to 0.7, above all 0.1 to 0.5.

The actually measured sizes of the cross-sectional areas at 1 mm intervals mentioned above of two different filaments are plotted in FIGS. 10 and 11. As is seen from these graphs, the filament in accordance with this invention is characterized by having a variation in cross-sectional area at irregular intervals along its longitudinal direction when it is observed, for example, with respect to a unit length of 5 mm.

Such a characteristic feature of the filament of this invention is believed to be attributed to the process of this invention which quite differs from conventional melt-spinning methods.

The filaments which constitute the fiber bundle of this invention are characterized by having a non-circular cross section as shown in FIGS. 1, 3, 4, 5 and 7 of the accompanying drawings.

A further feature of this invention is that as shown, for example, in FIGS. 12, 12*a* and 12*b*, the filament has a non-circular cross section irregularly varying in size at irregular intervals along its longitudinal direction, and incident to this, the shape of its cross section also varies.

The degree of non-circularity of the filament cross section can be expressed by an irregular shape factor which is defined as the ratio of the maximum distance (D) between two parallel circumscribed lines to the minimum distance (d) between them, (D/d). The filaments of this invention have an irregular shape factor (D/d) on an average of at least 1.1, and most of them have an irregular shape factor (D/d) of at least 1.2, as shown in FIG. 13.

As is clearly seen from FIG. 12, the filament of this invention is characterized by the fact that its irregular shape factor (D/d) varies along its longitudinal direction.

Furthermore, this filament is characterized by the fact that in any arbitrary 30 mm length of the filament along its longitudinal direction, it has a maximum irregular shape factor difference $[(D/d)_{max}-(D/d)_{min}]$, defined as the difference between its maximum irregular shape factor $[(D/d)_{max}]$ and its minimum irregular shape factor $[(D/d)_{min}]$, of at least 0.05, preferably at least 0.1.

Synthetic filament-like fibers having the aforesaid characteristic features have been quite unknown prior to the present invention, and their morphological properties are similar to those of natural fibers such as silk.

Furthermore, according to this invention, as-spun filaments having irregular crimps at irregular intervals along their longitudinal direction, as shown in FIG. 14, can be obtained from many polymers.

The bundle of filament-like fibers in accordance with this invention is a bundle of numerous filaments composed of at least one thermoplastic synthetic polymer, and is characterized by the fact that (1) each of said filaments constituting said bundle has a variation in cross-sectional size at irregular intervals along its longitudinal direction, (2) said each filament has an intrafilament cross-sectional area variation coefficient [CV(F)] of 0.05 to 1.0, and (3) when said bundle is cut at any arbitrary position thereof in a direction at right angles to the filament axis, the sizes of the cross-sectional areas of the individual filaments differ from each other substantially at random.

The aforesaid characteristic (3) can be clearly understood from FIGS. 1, 3, 4, 5 and 7.

When the bundle of filament-like fibers of this invention is cut at an arbitrary position thereof in a direction at right angles to the filament axis, the intrabundle filament cross-section variation coefficient in the bundle, which represents variations in the cross sectional areas of the individual filaments, is within the range of 0.1 to 1.5., preferable 0.2 to 1.

The intrabundle filament cross-section variation coefficient [CV(B)], can be determined as follows: partial bundles composed of one hundred filament like fibers respectively are sampled from the aforesaid fiber bundle, and their cross sections at an arbitrary position are observed by a microscope and the sizes of the cross-sectional areas are measured. The average value ($\bar{B}$) of the cross sectional areas and the standard deviation ($\sigma_B$) of the 100 cross-sectional areas were calculated. CV(B) can be computed in accordance with the following equation (12).

$$CV(B)=\sigma_B/\bar{B} \qquad (12)$$

The bundle of filament-like fibers of this invention is further characterized by the fact that when the bundle is cut at an arbitrary position thereof in a direction at right angles to the filament axis, the cross sections of the individual filaments have randomly and substantially different sizes and shapes. This is clearly seen from FIGS. 1, 3, 4, 5, 7, and 12.

When the bundle of filament-like fibers of this invention is cut at an arbitrary position thereof in a direction at right angles of the filament axis, the cross-section of each filament is non-circular, and each cross section has an irregular shape factor (D/d), as defined hereinabove, of at least 1.1, and mostly at least 1.2, on an average. Furthermore, the aforesaid maximum difference in irregular shape factor $[(D/d)_{max}-(D/d)_{min}]$, as defined hereinabove, of the bundle of filament-like fibers of this invention is at least 0.05, preferably at least 0.1.

The fiber bundles of this invention obtained from many polymers have irregular crimps in the as-spun state, and the individual filaments constituting a single bundle have randomly different crimps. This fact is clearly seen, for example, from FIG. 15.

The irregular different crimps of the individual filaments can be rendered more noticeable by subjecting the as-spun fibrous bundle to boiling water treatment without prior drawing or if desired after drawing, as seen in FIGS. 16 and 17.

A preferred fiber bundle of this invention is a bundle of numerous filament-like fibers composed of a thermoplastic synthetic polymer, in which when the individual fibers of the bundle are cut in a direction at right angles to the fiber axis, their cross sections have different shapes and sizes, and moreover have the following characteristics in accordance with the definitions given in the present specification.

(i) The fibers constituting the bundle have an average denier ($\bar{D}e$) in the bundle of 0.01 to 100 denier.

(ii) The fibers constituting the bundle have an intrabundle filament cross-sectional area variation coefficient, CV(B), of 0.1 to 1.5.

(iii) The intrafilament cross-sectional area variation coefficient [CV(F)] in the longitudinal direction of the fibers constituting the bundle is 0.05 to 1.0.

The average denier size ($\bar{D}e$) in the bundle can be determined as follows: Ten bundles each consisting of 100 fibers are sampled at random from the bundle (for simplicity, three such bundles will do; the results is much the same for both cases), and each bundled mass is cut at one arbitrary position in the axial direction of fiber in a direction at right angles to the fiber axis. The cross section is then photographed through a microscope on a scale of about 2000 times. The individual fiber cross sections are cut off from the resulting photograph, and their weights are measured. The total weight is divided by the total number of the cross-sectional microphotographs, and the result [m(A)] is calculated for denier (de).

Accordingly, the average denier size ($\bar{D}e$) in the bundle is calculated in accordance with the following equation.

$$\bar{D}e=K\cdot m(B)$$

wherein m(B) is the weight average value of the photographic fiber cross sections cut off; and K is a denier calculating factor defined by the equation $$K=\frac{9\times 10^5\cdot\rho}{\alpha\cdot\beta}$$

in which $\alpha$ is the weight (g) of the unit area of the photograph, $\beta$ is the ratio of area enlargement of the photograph, and $\rho$ is the specific gravity of the thermoplastic polymer, all these values being expressed in c.g.s. unit.

When the bundle of filament-like fibers of this invention are produced from a blend of two or more polymers, or from a foamable polymer melt obtained by mixing a polymer melt with a gas or a gas-generating substance, or from a highly viscous polymer melt, numerous continuous streaks are formed on the surfaces of the filament-like fibers along the fiber axis.

When, as shown in FIGS. 18*a* and 18*b*, the fiber bundle is cut in a direction at right angles to the fiber axis and the cut section is photographed at a magnification of 1000 to 3000X by a scanning electron microscope at an angle of 45° to the fiber axis, the formation of such numerous streams on the fiber surfaces along the fiber axis can be recognized by observing the photograph obtained.

Stripes which appear in fibers of irregularly-shaped cross section (e.g., a star-like shape, a triangular shape) which are obtained when extruding a thermoplastic polymer through spinning nozzles having a geometrical configuration do not come within the definition of the aforesaid "streaks". The "streaks", as used in this invention, denote streaks in the direction of the fiber axis which can be perceived at a relatively gentle surface portion on the side surface of the fiber axis in the aforesaid photograph.

An especially preferred fiber bundle of this invention is the one in which the formation of continuous streaks along the fiber axis can be recognized in an area occupying at least 30%, preferably at least 40%, of its visible surface in the surfaces of at least 50% of the fibers of the bundle when they are observed on the basis of photographs.

When a woven fabric, for example, is produced from the fiber bundle having such streaks on the fiber surfaces, its tactile hand and surface characteristics, such as scroop, and luster, are very similar to those of silk fabrics by the combination of such streaks with the aforesaid variations in cross-sectional size and shape in the longitudinal direction. Moreover, the advantages of synthetic polymer in function, etc. are conferred to such fabrics.

Such streaks are not present in all fiber surfaces in the fiber bundle of this invention, and the presence or absence of streaks and their amount depend upon the type and combination of thermoplastic synthetic polymers, the structure of the polymer extruding surface of the spinneret, the conditions for cooling the surface of the spinneret, etc.

Investigations of the present inventors have shown that generally, streaks are more liable to form in the case of using a mixture of two or more polymers than in the case of using a single polymer; that as the ratio between elevations and depressions on the polymer extrusion surface (i.e., the $\bar{h}/\bar{d}$ ratio) is larger, fibers with streaks are easier to obtain; and that as the relative temperature ratio $\theta$ of the extrusion surface is smaller, i.e. as the cooling of the spinneret surface is stronger, fibers with streaks are easier to obtain. The aforesaid type and combination of polymers, the ratio between elevations and depressions at the extrusion surface, and the conditions for cooling the extrusion surface are not absolute conditions for obtaining fibers with streaks. The formation of streaks depends also upon other various conditions, and the interaction of these factors leads to the formation of streaks.

It has been found that a bundle of fibers having many streaks on their surfaces can be obtained when (a) a mixture of two polymers (especially those having dissimilar physical properties) in a varying mixing ratio from 30:70 to 70:30 is used as a raw material, (b) the $\bar{h}/\bar{d}$ ratio at the extrusion surface of the spinneret is at least 0.5, and (c) the relative temperature ratio $\theta$ on the extrusion surface is not more than 1.03. It is not necessary to satisfy all of the three requirements (a), (b) and (c), and a bundle of fibers having streaks can be obtained even when either one or two of these requirements are met.

According to the present invention, there can also be provided a bundle of filament-like fibers which when cut at right angles to its fiber axis, present many filament cross sections some of which have a whisker-like protrusion extending in a random direction, as clearly seen in FIG. 22 (Example 31). A fiber bundle having such a protrusion in some of the filament cross sections is also seen in FIG. 4 although not as typically as in FIG. 22.

When the base polymer of the fiber bundle of this invention is a crystalline and orientable polymer, the as-spun fibers, in many cases, have some degrees of crystallinity and orientability as seen in FIG. 19. The crystallinity and orientability can be further increased by drawing the fiber bundle with or without subsequent heat-treatment.

Even when the as-spun fiber bundle is drawn with or without subsequent heat-treatment, its CV(F) and CV(B) do not fall outside the ranges specified hereinabove.

Drawing, of course, improves such properties as tenacity and Young's modulus, of the fiber bundle.

When a general bundle (tow) of filaments obtained by ordinary orifice spinning is drawn beyond the drawable limit (maximum draw ratio), the bundle breaks off at nearly one point. In contrast, when the fiber bundle of this invention is drawn beyond the maximum draw ratio, it does not abruptly break off at the same position because of the irregularity of the fibers in the longitudinal direction. Thus, the fibers break off at random in the bundle, and therefore, a bundle having partially cut fibers can be produced.

By utilizing this phenomenon, a bundle similar to a sliver in spinning and a bulky yarn-like product having similar properties to those of a spun yarn can be easily produced directly.

By drawing the fiber bundle of this invention, the bonded points of the filaments are cut, and the average distance between bonded points becomes longer, thereby yielding a bundle of filament-like fibers having a long distance between bonded points, although this depends upon the draw ratio. In some case, there can be obtained a fiber bundle which is composed substantially of long fibers with substantially no bonded points.

Such a fiber bundle in which bonded points between filaments scarcely exist can also be obtained by imparting a physical stress to the fiber bundle in an axial direction of the fibers, for example by drawing. Alternatively, a bundle of continuous filaments with scarcely no bonded points can be obtained by expanding the fiber bundle in a direction at right angles to the fiber axis to cut the bonded points.

The fiber bundle of this invention, whether it contains relatively many bonded points or only little bonded points, can be cut to a suitable length in a direction at right angles to the fiber axis to form short fibers. Needless to say, an assembly of such short fibers also falls within the category of the fiber bundle of this invention so long as it meets the requirements specified in this invention. Suitable short fibers so formed have an average length of not more than 200 mm, preferably not more than 150 mm. The fiber bundle of this invention cut to short fibers may be used as such or as a mixture with other fibers. If the fiber bundle of this invention is contained in the mixture in an amount of at least 10% by weight, preferably at least 20% by weight, the characteristic features of the fiber bundle of this invention can be exhibited. Furthermore, the short fibers, either alone or in combination with other short fibers, may be used to produce spun yarns.

The cross-sectional size and shape of the fiber bundle of this invention, the distribution thereof, and the variations of the fiber cross-section along the fiber axis are within certain fixed ranges, and such a fiber bundle cannot be obtained by known fiber manufacturing methods. The structural properties of the bundle are interesting and have not been obtained heretofore.

The ranges of such cross-sectional size and shape, the distribution thereof, and the variations of the fiber cross-section along the fiber axis are partly similar to those of natural fibers such as silk or wool, and therefore, the present invention can provide synthetic fibers which have similar tactile hand and properties to natural fibers.

Thus, the fiber bundle of this invention can be used as a material for woven or knitted fabrics, non-woven fabrics, and other fibrous products.

In many case, the fiber bundle of this invention develops crimps to a greater degree by heat-treatment because of the proper irregularity in the fiber cross section along the longitudinal direction and of the anisotropic cooling effect imparted at the time of forming the fibers. This property can be utilized in increasing fiber entanglement.

The fiber bundle of this invention is also useful in producing crosslapped nonwoven fabrics, random-laid nonwoven fabrics obtained by application of electrostatic charge or air, artificial leathers, etc.

The following Examples illustrate the present invention more specifically without any intention of limiting the invention thereby.

EXAMPLE 1

A bundle of filament-like fibers was produced from polypropylene (fiber grade, m.p. 440° K.; a product of Ube Industries, Ltd.) using an apparatus of the type shown in Example 8 except that the spinneret 7 had a one hole-type fiber-forming area, and the cooling device 8 immediately below the spinneret had a one hole-type slit nozzle.

Specifically, polypropylene chips were continuously fed at a constant rate to an extruder 2 having an inside cylinder diameter of 30 mm, and kneaded and melted at a temperature of 200° to 300° C. By means of a gear pump 5, the molten polymer was sent to a spinning head 6 at a rate of 12 g per minute, and extruded from the spinneret in which the fiber-forming area had an area ($S_o$) of about 11 $cm^2$.

The spinneret used was the one shown in the first spinning embodiment of the invention described hereinabove. It was constructed by providing grooves of V-shaped cross section (width about 0.7 mm, depth about 0.7 mm) on the surface of a spinneret having 1000 straight holes having a diameter of 0.5 mm used in conventional orifice spinning so that the grooves formed an angle of about 45° C. and about 135° C. to the arrangement of the orifices.

The specific fiber-forming conditions for the bundle of filament-like fibers are shown in Table 1. The polymer extruding surface of the spinneret and its vicinity were cooled by applying an air stream from a cooling device having a gas jet nozzle located immediately below the spinneret. The speed of the air stream which passed through the bundle of filaments was 7 m per second. Thus, there was obtained a bundle of filament-like fibers having a total size of 14,000 denier and the cross-sectional shape shown in FIG. 1 at a rate of 8 m per second.

The coefficient of intrafilament cross sectional area variation [CV(F)] and the intrafilament irregular shape factor $(\overline{D/d})_F$ of the resulting fiber bundle, measured by the methods described below, were 0.18, and 1.22, respectively.

One filament was arbitrarily selected from the fiber bundle, and an arbitrary point of it was embedded in a fiber fixing ester-type cured resin (a product of Japan Reichhold Co., Ltd.). The fixed part was sliced to a thickness of 15 microns by a microtome (ULTRA MICROTOME, a product of Japan Microtome Laboratory, Co., Ltd.). An enlarged photograph of the sliced sample was taken through an optical microscope (a metal microscope, a product of Nikon Co., Ltd.). The photograph of the fiber cross section was cut off, and precisely weighed. The weight was then converted to the area of the cross section. In this manner, the areas of the individual cross sections of the non-circular filament were measured.

The cross sections of one filament at 1 mm intervals were determined using a 3 cm-long sample embedded in the aforesaid resin; the cross sections of one filament at 2 mm intervals, using a 6 cm-long sample embedded in the resin; and the cross sections of one filament at 10 cm intervals, using a 30 cm-long sample embedded in the resin. Thus, in each case, the average of the thirty cross sections was calculated in accordance with equation (11) given hereinabove.

The irregular shape factor $(\overline{D/d})$ of the fiber cross section and the maximum difference in irregular shape factor $[(D/d)_{max}-(D/d)_{min}]$ (to be sometimes referred to as DIF) were measured by the methods described hereinabove by utilizing the aforesaid enlarged photograph.

EXAMPLE 2

Polypropylene chips (PP for short) were melt-extruded and taken up while being cooled using the same molding apparatus as used in Example 1 except having a different spinneret. A bundle of filament-like fibers having the sectional shape shown in FIG. 3*a* was obtained.

The spinneret used in this Example was a plain weave wire mesh with a raised and depressed surface having a $\bar{p}$ of 0.321 mm, an $\bar{h}$ of 0.117 mm, and a $\bar{d}$ of 0.220 mm. This process corresponds to the second spinning embodiment described in the specification.

The values of $\bar{p}$, $\bar{h}$ and $\bar{d}$, as defined in the specification, were specifically measured by cutting the plain weave wire mesh at six sections at every 30° around a given point, photographing the cut sections on an enlarged scale using an optical microscope, and analyzing the many photographs obtained.

The spinning conditions are shown in Table 1. There was obtained a bundle of filament-like fibers which had a total denier size of 13,000 denier and a distance between bonded points per filament of 6 m and was very weakly net-like.

The distance between bonded points was determined as follows: A 10 cm-long sample was cut off from the resulting fiber bundle, and 200 filaments were taken out from the sample carefully by a pair of tweezers. The number of points at which two filaments adhered to each other was measured, and the distance between the bonded points was calculated in accordance with the following equations.

$$\text{Distance between bonded points} = \frac{0.1\ (\text{m}) \times 200}{\text{number of the bonded points}}$$

The average single filament denier ($\overline{De}$) of the fiber bundle obtained in this Example was 1.4 denier, and solidification cross sectional area [$\overline{A_L}$] was $0.17\times10^{-5}$ $cm^2$. The solidification length, measured by observation with an optical microscope, was 0.2 cm.

The average single filament denier [$\overline{De}$] of the bundle of filament-like fibers was determined by photographing the cross section of the fiber bundle using a scanning electron microscope (Model JSM-$U_3$, a product of Nippon Denshi K.K.), cutting off the individual cross sections of the filaments in the photograph, precisely weighing them, converting the weights to cross sectional areas, and applying the results to the equation shown hereinabove in the specification.

The solidification cross-sectional area [$\overline{A_L}$] was calculated from the average single filament denier [$\overline{De}$] in accordance with equation (10) shown in the specification.

The solidification length [$\overline{L_f}$] was determined as follows:

In a stage in which a bundle of filament-like fibers was being stably produced, a stream of dry carbon dioxide cooled to the freezing point was blown against a part of the end of the surface of the fiber-forming area of the spinneret to freeze and solidify the fibrous streams of the polymer melt extruded from the small openings in the spinneret. The solidified fibrous streams were removed from the spinneret. Thus, a bundle of more than 20 filament-like fibers having an attenuated part at the end was collected. The diameter of the attenuated part of each of these filaments was measured by using an optical microscope at intervals of 100 microns in the longitudinal direction of the fiber, and an attenuation curve was drawn for each filament on the basis of the obtained data. By analyzing the attenuation curve, the solidification length of each filament was determined, and as an average of the solidification lengths, the solidification length [$\overline{L_f}$] was determined.

In the present Examples, the number of filament-like fibers per unit area (1 $cm^2$) at a position apart from the spinneret by a distance corresponding to the solidification length was 290. This number is far larger than that obtainable by a conventional orifice-type melt-spinning method.

Three filaments were selected arbitrarily from the fiber bundle obtained in this Example, and their cross-sectional area variation coefficient values CF(F) (1 mm intervals), were determined. Specifically, CV(F) was measured for each filament at six 3 cm-long portions taken from both ends of a 0.5 m interval, a 1 m interval and a 1.5 m interval of these three filaments, respectively. All of the CV(F) values obtained were within the range of 0.15 to 0.35. At these six parts, the irregular shape factor of the fiber cross section and the maximum difference in irregular shape factor were measured in the same way as in Example 1. The results were not much different from the values given in Table 2.

The tenacity and elongation of a single filament in the fiber bundle of this invention were 0.86 g/de and 150%, respectively. The measurement was made by using a tension meter (Model VTM-II, a product of Toyo Sokki K.K.) on 30 arbitrarily selected fibers, and the average values were calculated.

The fiber bundle was dipped in boiling water for 10 minutes, and air-dried. The individual filaments were selected from the fiber bundle, and the number of crimps was observed by an optical microscope. It was 6.5N/20 mm on an average.

The fiber bundle obtained in this Example was drawn to 2.4 times in a hot water bath at 90° to 100° C., and the properties of the drawn filaments were measured in the same way as in the case of undrawn filaments. The results are shown in Table 2. After drawing, spontaneous crimps were still present, and the tenacity of the filaments was sufficiently high for various applications.

EXAMPLE 3

Using the same apparatus as in Example 2 except having a different type of spinneret, polypropylene chips were melt-extruded and taken up while cooling to form a bundle of filament-like fibers.

The spinneret used was a twill weave wire mesh (Level Weave Wire Mesh made by Nippon Filcon Co., Ltd.) having a [$\overline{p}$] of 0.380 mm, an [$\overline{h}$] of 0.085 mm and a [$\overline{d}$] of 0.300 mm. The extrudate was taken up while cooling under the spinning conditions shown in Table 1. The resulting fiber bundle had a total denier size of 29,000 denier and an average filament denier of 1.8 denier. A cross section taken at an arbitrary position of the resulting fiber bundle is shown in the electron microphotograph of FIG. 3*b*. The form and properties of the undrawn filaments of the fiber bundle are shown in Table 2.

The resulting fiber bundle was subjected to X-ray diffraction analysis using an X-ray wide-angle device (Model RU-3H, a product of Rigaku Denki Kogyo K.K.) under the following conditions.

KVP: 80 mA
Target: Cu
Filter: Ni
Pinhole slit: 0.5 mm in diameter
Exposure time: 60 minutes
Camera radius: 5 cm Thus, the X-ray diffraction photograph of FIG. 19 was obtained.

The forms and properties of undrawn and drawn filaments of the fiber bundle obtained in this Example are shown in Table 2.

EXAMPLE 4

Using the same molding apparatus as in Example 2 except having a different spinneret, polypropylene chips were melt-extruded, and taken up while cooling to afford a bundle of filament-like fibers.

The spinneret used was a plain weave wire mesh in which tapered pins were protruded in zigzag form at every other small opening in the mesh (the one used in the third spinning embodiment of the invention). The [$\overline{p}$], [$\overline{h}$], and [$\overline{d}$] values of the spinneret were very large as shown in Table 1, but under the spinning conditions shown in Table 1, a bundle of thick filament-like fibers having an average filament size of 39.0 denier was obtained. The form and properties of the undrawn filaments of the fiber bundle are shown in Table 2.

EXAMPLE 5

Using the same molding apparatus as used in Example 2 except having a different spinneret, polypropylene chips were melt-extruded and taken up while cooling to afford a bundle of filament-like fibers.

The spinneret used was a porous plate-like structure of sintered metal obtained by closely packing and aligning numerous small bronze balls and cementing them by sintering, as shown in the fourth spinning embodiment in the present invention. The surface of the spinneret had hemispherical elevations and depressions, and the area porosity was about 9%. Observation with an optical microscope showed that the small openings through which the molten polymer was extruded had quite non-uniform sizes and shapes. Nevertheless, under the spinning conditions shown in Table 1, a bundle of filament-like fibers having a total denier size of 13,000 denier was obtained stably by taking up the extrudate at a rate of 30 meters per minute while cooling.

When a cross section at an arbitrary point of the resulting fiber bundle was observed with a scanning electron microscope, the cross sections of the individual filaments were non-uniform in shape and assumed a slightly distorted rectangular shape, as shown in FIG. 4.

The fiber bundle was drawn to 3.2 times in a hot water bath at 90° to 100° C. The cross-sectional area variation coefficient [CV(F)], irregular shape factor $[\overline{D/d}]$, and the maximum difference in irregular shape factor $[(D/d)_{max}-(D/d)_{min}]$ of the undrawn filaments and the drawn filaments are shown in Table 2.

EXAMPLE 6

Using the same molding apparatus as in Example 2 except having a different spinneret, polypropylene chips were melt-extruded and taken up while cooling to afford a bundle of filament-like fibers.

The spinneret used was obtained by longitudinally aligning a very large number of stainless steel plain weave meshes having a wire diameter of about 0.2 mm and a percentage of open area of about 30%, and compressing them so that they were arranged at a high density, as shown in the fifth spinning embodiment of the present invention.

When this spinneret was used, the polymer melt was extruded such that it oozed out onto the individual planes of the wire meshes through the openings between the stacked wires, and a bundle of filament-like fibers having the cross sectional shape shown in the scanning electron microphotograph of FIG. 5 was obtained.

Even when the cross-sectional shape of the filaments was irregular, the cross-sectional area variation coefficient [CV(F)] of the filaments was within a certain fixed range. The fiber bundle could be drawn to 2.9 times in a hot water bath at 90° to 100° C. The tactile hand of the filaments was unique.

The distance between bonded points of the fiber bundle determined by the method described in Example 2 was 0.9 m.

EXAMPLE 7

Using the same molding apparatus as used in Example 2 except having a different spinneret, polypropylene chips were melt-extruded and taken up while cooling to afford a bundle of filament-like fibers.

The spinneret used was obtained by stacking a number of metal plates having a sawtooth-like shape at their tip at an interval of about 0.25 mm in the longitudinal direction, as shown in FIG. 6. This spinneret is described hereinabove with regard to the sixth spinning embodiment.

A scanning electron microphotograph of a cross section taken at an arbitrary point of the bundle of filament-like fibers thus obtained is shown in FIG. 7. The cross section of this fiber bundle was similar to that of the filament-like fiber bundle obtained in Example 6. However, when the spinning conditions were changed, the cross sectional shapes of filmanent bundles obtained in the fifth embodiment and the sixth embodiment were frequently different.

The form and properties of the filament-like fiber bundle obtained in this Example are shown in Table 2.

EXAMPLES 8 TO 14

Using a molding apparatus having the same spinneret as in Example 3, chips of each of the following polymers were melt-extruded, and taken up while cooling under the spinning conditions indicated in Table 1. Thus, bundles of filament-like fibers composed of these polymers were obtained.

Polyethylene:
- high-density grade, m.p. 404° K. (abbreviated PE; a product of Ube Industries, Ltd.)

Polystyrene:
- Styron-666 grade, m.p. 473° K. (abbreviated P.St; a product of Asahi Dow Co., Ltd.)

Nylon 6:
- intrinsic viscosity 1.3, m.p. 496° K. (abbreviated Ny; a product of Teijin Limited)

Polybutylene terephthalate:
- intrinsic viscosity 1.1, m.p. 496° K. (abbreviated PBT, a product of Teijin Limited)

Polycarbonate:
- average molecular weight 24000, m.p. 513° K. (abbreviated PC; a product of Teijin Limited)

Polyethylene terephthalate:
- intrinsic viscosity 0.71, m.p. 513° K. (abbreviated PET; a product of Teijin Limited)

Polyester elastomer:
- Hytrel 5556 grade, m.p. 484° K. (abbreviated PEs-Elas; a product of Du Pont)

Figure 3B:
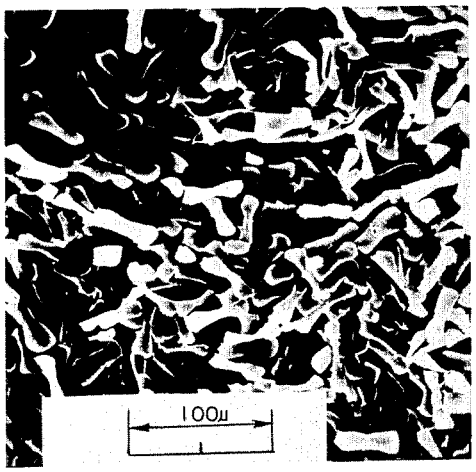

The cross-sectional shape of the individual filaments in each of the fiber bundles obtained in these Examples was much the same as that shown in FIG. 3*b*, and assumed a non-uniform cocoon-like shape.

The forms and properties of the fiber bundles obtained in these Examples are shown in Table 2. When these fiber bundles were treated under the drawing conditions (the temperature, draw ratio, etc.) suitable for the respective polymers, drawn filament-like fiber bundles having the forms and properties shown in Table 2 were obtained. They showed good tactile hand.

EXAMPLE 15

Using the same molding apparatus as in Example 2 except having a different spinneret, polypropylene chips were melt-extruded, and taken up while cooling to afford a bundle of filament-like fibers.

The spinneret used was a plain weave wire mesh having a $[\bar{p}]$ of 0.443 mm, an $[\bar{h}]$ of 0.139 mm and a $[\bar{d}]$ of 0.277 mm. Under the spinning conditions shown in Table 1, the extrudate was taken up at 27 m/min. at an apparent draft (as defined hereinabove) of as high as 3800 while cooling. The solidification length of the fiber bundle was as short as 0.11 cm. The form and properties of the resulting fiber bundle are shown in Table 2.

EXAMPLE 16

A bundle of filament-like fibers was produced in the same way as in Example 15 except that the polymer melt was extruded so that the amount of the polymer melt extruded per unit area of the fiber-forming area of the spinneret was very large, and the extrudate was taken up at a rate of 32 m/min. while cooling.

The solidification length of filament in this Example was 0.28 cm. Thus, even when the amount of the polymer melt extruded per unit area of the fiber-forming area of the spinneret was increased greatly, the attenuation of fibers ended within a short range of less than 1 cm.

EXAMPLE 17

Using the same molding apparatus as in Example 15 except having a different spinneret, polypropylene chips were melt-extruded, and taken up while cooling to afford a bundle of filament-like fibers having an average filament denier size of 31 denier.

The spinneret used was a plain weave wire gauze having the specification shown in Table 1.

In spite of the fact that the average single filament denier was very large, the solidification of the fiber bundle was as short as 0.6 cm.

The CV(F) and $(\overline{D/d})$ of the filaments were on the same level as those of a bundle of finer-denier filament-like fibers.

EXAMPLE 18

In this Example, a bundle of filament-like fibers was produced in a relatively large quantity.

Polypropylene chips (melting point 438° K., melt index 15) were continuously metered at a rate of 1070 g/min. and melt-extruded using an extruder having an inside screw diameter of 50 mm. The polymer melt was extruded using a molding apparatus similar to that shown in FIG. 8. In the spinneret, four fiber-forming areas of rectangular shape (150 cm × 5 cm) were aligned parallel to each other, and the polymer melt was extruded through a total area of 3,000 $cm^2$ covering these fiber-forming areas. The unevenness of the surface of the fiber-forming areas is shown in Table 1.

A cooling device composed of two tubular members with a jet nozzle and air sucking tubes for escape of cooling air was used, and the four fiber-forming areas were simultaneously cooled. The resulting bundle of filament-like fibers had a total denier size of about 1,100,000 denier. The principal properties of the fiber bundle are shown in Table 2.

EXAMPLE 19

Polypropylene chips (m.p. 438° K., melt index 20) were melted at 200° to 300° C. by an extruder having an inside cylinder diameter of 40 mm of the type shown in FIG. 8 to which was attached a spinneret having two parallel-laid fiber-forming areas of rectangular shape (500 mm × 50 mm) having a total area ($S_o$) of 500 $cm^2$. The polymer melt was extruded at a constant rate of 136 g/min. by a gear pump under the conditions shown in Table 1. The cooling device consisted of a tubular member having a jet nozzle disposed between the two parallel-laid molding areas. A cooling air stream was supplied at a rate of 7 to 10 m/sec. to the polymer extrusion surface of the spinneret and to its vicinity, and the extrudate was taken up at a rate of 612 cm/min. to form a bundle of filament-like fibers.

The principal properties of the resulting fiber bundle are shown in Table 2.

EXAMPLE 20

Chips of nylon 6 (m.p. 488° K.) were extruded at a rate of 170 g/min. in the same way as in Example 19. The spinneret conditions and fiber-forming conditions are shown in Table 1.

The principal properties of the resulting bundle of filament-like fibers are shown in Table 2.

EXAMPLE 21

Chips of polybutylene terephthalate (m.p. 505° K.) were continuously fed at a constant rate of 1,540 g/min. and melt-extruded using an extruder having an inside cylinder diameter of 60 mm, and the polymer melt was extruded from a spinneret having an uneven surface and a total fiber-forming area of 3,000 $cm^2$ as in Example 18. The conditions of the spinneret are shown in Table 1.

A cooling device consisting of a tubular member having a jet nozzle was used, and while a cold air stream was blown against the uneven extruding surface of the spinneret and to its vicinity, fine fibrous streams were taken up while solidifying them to obtain a bundle of filament-like fibers.

The fiber bundle had a CV(F) of 0.34 (at 1 mm interval) and a CV(B) of 0.5. The individual filaments had streaks along the filament axis and were of irregular shapes and denier sizes.

The other properties of the fiber bundle are shown in Table 2.

EXAMPLES 22 AND 23

Chips of polyethylene (m.p. 410° K., melt index 20) were melted and extruded in the same way as in Example 19 through a spinneret having a total fiber-forming area of 500 $cm^2$. The spinneret conditions and the fiber-forming conditions are shown in Table 1. (Example 22)

Chips of polyethylene terephthalate (m.p. 538° K.) were extruded in the same way as above under the fiber-forming conditions shown in Table 1. (Example 23)

EXAMPLES 24 AND 25

In a similar manner to Example 2, chips of polyethylene terephthalate (m.p. 540° K.) was melted and kneaded at 230° to 330° C. The molten polymer was extruded at a rate of 70 g/min. by a gear pump through a spinneret ($\bar{p}=0.443$, $\bar{h}=0.139$, $\bar{d}=0.277$) composed of a plain weave wire mesh having the same fiber-forming area as in Example 2, and taken up while cooling the polymer extruding surface of the wire and its vicinity with an air stream to form a bundle of filament-like fibers. (Example 24)

Chips of nylon 6 (m.p. 496° K.) were similarly extruded and taken up while cooling to afford a bundle of filament-like fibers. (Example 25)

The fiber-forming conditions and the properties of the resulting fiber bundle are shown in Tables 1 and 2.

EXAMPLES 26 AND 27

Using the same porous plate-like spinneret made of sintered metallic balls as described in Example 5 and having two parallel-laid rectangular fiber-forming areas each having an area of 500 mm × 50 mm (a molding apparatus of the type shown in FIG. 8), molten polyethylene (m.p. 410° K., melt index 20) was extruded at a rate of 140 g/min. While cooling the uneven surface of the fiber-forming areas and their vicinity by jetting in air at a rate of 7 to 15 m/sec from a cooling device having an air jet nozzle disposed between the two fiber-molding areas, the extrudate was taken up to obtain a bundle of filament-like fibers. (Example 26)

Chips of nylon 6 (m.p. 488° K.) were extruded similarly to form a bundle of filament-like fibers. (Example 27)

The fiber-forming conditions and the principal properties of the fiber bundles are shown in Tables 1 and 2, respectively.

EXAMPLE 28

Chips of a mixture of 70% by weight of nylon 6 (m.p. 496° C.) and 30% by weight of polypropylene (m.p. 440° K.) were extruded through a spinneret having the specification shown in Table 1, and taken up while cooling in the same way as in Example 26 to afford a bundle of filament-like fibers.

The resulting fiber bundle had a total denier size of about 120,000. The individual filaments had irregular cross sectional shapes and sizes, as shown in the scanning electron microphotographs of FIG. 18*a* (about 1000 X) and FIG. 18*b* (about 3000 X) taken at an angle of 45° to the filament axis. Many continuous streaks are clearly seen to appear on the surface of the filaments along the filament axis.

The CV(F) (1 mm interval) was 0.36; $(D/d)_F$ was 1.67; and CV(B) was 0.9.

The other principal properties of the fiber bundle are shown in Table 2.

EXAMPLE 29

Chips of a mixture of 60% by weight of polybutylene terephthalate (m.p. 505° K., intrinsic viscosity 1.2) and 40% by weight of polyethylene (m.p. 410° K., melt index 20) were melted and extruded by using the same molding apparatus as shown in FIG. 8 having a spinneret with the specifications indicated in Table 1, and taken up while cooling the uneven extrusion surfaces of the molding areas in the same way as in Example 16 to form a bundle of filament-like fibers.

The principal properties of the resulting fiber bundle are shown in Table 2. It was found that after drawing, the individual filaments had irregular cross-sectional shapes and sizes.

EXAMPLE 30

Chips of a mixture of 60% by weight of polypropylene (m.p. 438° K.) and 40% by weight of nylon 6 (m.p. 488° K.) were fed continuously to a vent-type extruder having an inside cylinder diameter of 40 mm (of the type shown in FIG. 8), melt-extruded at 200° to 300° C. Nitrogen gas under a pressure of 60 kg/cm$^2$ was introduced from the vent portion (designated at 3 in FIG. 8) of the extruder using a gas supplying device (designated at 4 in FIG. 8), and was fully kneaded with the molten polymer. The resulting foamable molten polymer was extruded by means of a gear pump (shown at 5 in FIG. 8) through the same spinneret as used in Example 19 at a rate of 150 g/min. Thus, a bundle of filament-like fibers was obtained.

When two or more polymers are used as in the present Example, the melting point or melt viscosity of the mixture, for practical purposes, is obtained by multiplying the melting points or melt viscosities of the constituents polymers respectively by the mixing proportions, and totalling the products obtained. This is applicable even when a gas is incorporated into the mixture. This approximation causes no trouble in actual operation.

Thus, in the present Example, the melting point and melt viscosity of the polymer mixture were calculated as follows:

Melting point $(Tm)=(438\times0.6)+(488\times0.4)\approx467°$ K.

Melt viscosity $=(1100\times0.6)+(7000\times0.4)\approx3{,}500$ poises.

The resulting fiber bundle had a total denier size of 200,000 denier, and the distance between bonded points of the filaments was about 2 m on an average.

The individual filaments of the fiber bundle had irregular cross-sectional shapes and sizes as clearly seen from the electron microphotograph of FIG. 21.

EXAMPLE 31

Using the same molding apparatus as used in Example 2 except having a different spinneret, polypropylene chips were melt-extruded and taken up while cooling to afford a bundle of filament-like fibers.

The spinneret used was a twill weave wire mesh having a $\bar{p}$ of 0.212 mm, an $\bar{h}$ of 0.160 mm and a $\bar{d}$ of 0.158 mm (Longcrimp Weave Wire Mesh, or Semi-Twilled Weave Wire Mesh, made by Nippon Filcon Co., Ltd.). Under the spinning conditions shown in Table 1, the extrudate was taken up while cooling to afford a bundle of filament-like fibers having a total denier size of 108,000 denier and an average filament denier size of 17.0 denier.

FIG. 22 is an optical microphotograph of a cross section, taken at an arbitrary point, of the resulting filament bundle. It is seen from this photo that the individual filament cross sections are of distorted rectangular shape, and many of them partly had whisker-like protrusions.

When the take-up speed of the filament bundle in this Example was varied over a wide range, the size of the whisker-like protrusions shown in FIG. 22 and the frequency of forming such whisker-like protrusions varied greatly.

The form and properties of the resulting filament bundle are shown in Table 2.

COMPARATIVE EXAMPLE 1

Polypropylene was melted and extruded through a plain weave wire mesh having a very fine uneven structure shown in Table 1 in the same way as in Example 2, the polymer melt formed a sea phase covering the entire mesh. While quenching the extrusion surface of the mesh and its vicinity, attempt was made to take up the polymer extrudate. But because of the raised and depressed structure of the extrusion surface of the mesh was too fine, non-polymer phases (islands) were not formed, and it was difficult to convert the polymer melt into fine fibrous streams. The polymer extrudate was a film-like product resembling a mass of closely and continuously adhering filaments.

The spinneret used was a stainless steel plain weave wire mesh having $\bar{p}$ of 0.02 mm, an $\bar{h}$ of 0.007 mm and a $\bar{d}$ of 0.01 mm.

COMPARATIVE EXAMPLE 2

Similarly to Example 2, a stainless steel plain weave mesh was laid in the inside of a die, and a plain weave wire mesh having a coarse uneven structure having a $\bar{p}$ of 4.08 mm, an $\bar{h}$ of 0.462 mm and a $\bar{d}$ of 1.308 mm was used as the surface of the fiber-forming area of the spinneret. Polypropylene and nylon 6 in the molten state were respectively extruded through the extruding surface of the wire mesh in order to fiberize them. No fibrous product could be obtained because the extrudates adhered to each other.

When the extruding surface was excessivey quenched to inhibit melt-adhesion, melt fracture occurred in the extrudates, and the melt extruded from one small opening in the wire mesh did not move to and from the melt extruded from another opening adjacent thereto or vice versa. Hence, breakage of the extrudates occurred frequently, and the product became a plastic rod-like structure. Thus, continuous fiberization was difficult. The data obtained with regard to polypropylene are given in Table 1.

COMPARATIVE EXAMPLE 3

Using a spinneret composed of a 5 mm-thick stainless steel flat plate having provided therein numerous orifices with a diameter of 0.5 mm at 1 mm pitch intervals, polypropylene, nylon-6, and polyethylene terephthalate were respectively melt-extruded in a similar manner to Example 1. In all cases, the extrudates adhered to each other because of the barus effect or the bending phenomenon, and no fibrous product intended by the present invention could be obtained.

When the extrusion surface of the spinneret was excessively quenched to inhibit melt-adhesion, melt fracture occurred in many oficies to cause breakage of the filamentary products. Thus, a rod-like extrudate resulted, and continuous stable fiberization was difficult.

The data obtained for polypropylene are shown in Table 1 as a representative example.

COMPARATIVE EXAMPLE 4

Polypropylene was extruded in the same way as in Example 3 except that the cooling of the extrusion surface of the spinneret was not at all performed. The polymer melt extruded from the fiber-forming area formed a sea phase covering the entire fiber-forming area, and the polymer melt dropped off from the sea phase as masses. Even when the temperature of the polymer was changed over a wide range, its fiberization was quite difficult.

COMPARATIVE EXAMPLE 5

One hundred parts by weight of polypropylene and 1 part by weight of talc were melted by a vent-type extruder, and nitrogen gas was supplied from the vent portion. While kneading these materials, the resulting foamable polymer was extruded from a circular slit die having a diameter of 140 mm and a slit clearance of 0.25 mm. The foamable polymer extruded from the slit die was taken up while immediately cooling it with a cooling air near the extrusion opening. Thus, a network fibrous sheet having a total denier size of 6000 denier was obtained.

The sheet obtained was extended to about 2 times in a direction at right angles to the take-up direction, and the distances between bonded points of the fibers in the sheet were actually measured within a range of about $10\times 10$ cm$^2$. The average of the measured distances was about 6 mm.

Because the distance between fiber bonded points was too short in the above sheet, the CV(F) at 1 mm interval varied greatly from 0.65 to 1.58, and the CV(B) also varied from 0.78 to 1.65, depending upon the places of measurement. This is because the bonded points are of Y-shape and the distance between bonded points is very short. When compared with a bundle of filament-like fibers in accordance with this invention which has a distance between fiber bonded points of at least 30 cm on an average, a CV(F) of less than 1.0 and a CV(B) of less than 1.5, the network fibrous sheet obtained in this Comparative Example has bonded points at a very high density, and is naturally different from the fiber bundle of this invention.

TABLE 1

| Example<br>Spinning embodiment | | | 1<br>1st | 2<br>2nd | 3<br>2nd | 4<br>3rd | 5<br>4th | 6<br>5th | 7<br>6th |
|---|---|---|---|---|---|---|---|---|---|
| Spinneret | | | | | | | | | |
| (1) Material for the extrusion surface | | | V-groove | plain weave mesh | twill weave mesh | needle-like members | sintered metal balls | longitudinally stacked meshes | saw-tooth-like plates |
| (2) Total fiber-forming area | So | $cm^2$ | 11.1 | 32 | 32 | 15 | 32 | 28 | 20 |
| (3) Average distance between extrusion openings | $\bar{P}$ | mm | 2.22 | 0.321 | 0.380 | 3.472 | 0.530 | 0.845 | 0.362 |
| (4) Average hill height | $\bar{h}$ | mm | 0.233 | 0.117 | 0.109 | 2.00 | 0.224 | 0.500 | 0.200 |
| (5) Average hill width | $\bar{d}$ | mm | 1.830 | 0.220 | 0.300 | 0.471 | 0.448 | 0.157 | 0.242 |
| | $\bar{h}/\bar{d}$ | | 0.127 | 0.532 | 0.363 | 4.240 | 0.500 | 3.185 | 0.826 |
| | $(\bar{P} - \bar{d})/\bar{P}$ | | 0.176 | 0.315 | 0.211 | 0.864 | 0.155 | 0.814 | 0.331 |
| (6) Number of elevations | $n_{(m)}$ | $N/cm^2$ | 204 | 422 | 760 | 48 | 322 | 592 | 1,000 |
| Polymer | | | | | | | | | |
| (7) Type | | | PP | PP | PP | PP | PP | PP | PP |
| (8) Density (at room temperature) | $\rho$ | $g/cm^3$ | 0.91 | 0.91 | 0.91 | 0.91 | 0.91 | 0.91 | 0.91 |
| (9) Melting point | Tm | °K. | 440 | 440 | 440 | 440 | 440 | 440 | 139.1 |
| (10) Viscosity (at 1.1 Tm) | $\eta$ | poise | 2,300 | 2,300 | 2,300 | 2,300 | 2,300 | 2,300 | 2,300 |
| Primary | | | | | | | | | |
| (11) Polymer temperature (at x = −0.5) | $t_{-5}$ | °C. | 267 | 262 | 250 | 260 | 260 | 250 | 246 |
| (12) Polymer temperature (at x = −0.2) | $t_{-2}$ | °C. | 232 | 222 | 216 | 229 | 200 | 210 | 202 |
| (13) Total amount of extrusion | W | g/min | 12 | 42 | 42 | 20 | 42 | 35 | 22 |
| (14) Velocity of cooling air (at x = 0.5) | $v_y$ | m/sec | 7 | 16 | 14 | 10 | 15 | 16 | 16 |
| (15) Take-up speed | $V_L$ | cm/min | 800 | 3,000 | 1,300 | 900 | 3,000 | 1,000 | 900 |
| Secondary | | | | | | | | | |
| (16) Polymer temperature (at x ≈ 0) | $t_o = (5 \cdot t - 2) - (2 \cdot t - 5)/3$ | °C. | 209 | 195 | 193 | 208 | 160 | 183 | 173 |
| (17) Relative temperature | $\theta = (t_o + 273)/Tm$ | | 1.09 | 1.06 | 1.06 | 1.1 | 0.98 | 1.03 | 1.01 |
| (18) Amount of extrusion per $cm^2$ | $w = W/So$ | $g/min \cdot cm^2$ | 1.08 | 1.31 | 1.31 | 1.33 | 1.31 | 1.25 | 1.25 |
| (19) Apparent draw ratio | $Da = V_L\rho/w$ | | 674 | 2,084 | 903 | 615 | 2,084 | 728 | 655 |
| (20) Total denier | $\Sigma De = (W/V_L) \cdot 9 \times 10^5$ | de | $0.14 \times 10^5$ | $0.13 \times 10^5$ | $0.29 \times 10^5$ | $0.2 \times 10^5$ | $0.13 \times 10^5$ | $0.32 \times 10^5$ | $0.22 \times 10^5$ |
| (21) Denier per $cm^2$ | $\Sigma De/So$ | $de/cm^2$ | 1,261 | 406 | 906 | 1,333 | 406 | 1,143 | 1,100 |
| Resulting | | | | | | | | | |
| (22) Average single filament denier | $\overline{De}$ | de | 15.5 | 1.4 | 1.8 | 39.0 | 2.1 | 2.2 | 2.5 |
| (23) Total number of filaments | $N = \Sigma De/\overline{De}$ | | 900 | 9,286 | 16,111 | 512 | 6,190 | 14,545 | 8,800 |
| (24) Number of filaments per $cm^2$ | $\bar{n} = N/So$ | $1/cm^2$ | 81 | 290 | 503 | 34 | 193 | 519 | 440 |
| (25) Solidification cross-sectional area | $A_L = \frac{\overline{De}}{9 \times \rho} \times 10^{-5}$ | $cm^2$ | $1.89 \times 10^{-5}$ | $0.17 \times 10^{-5}$ | $0.22 \times 10^{-5}$ | $4.8 \times 10^{-5}$ | $0.26 \times 10^{-5}$ | $0.27 \times 10^{-5}$ | $0.31 \times 10^{-5}$ |
| (26) Solidification length | $\bar{L}f$ | cm | 0.3 | 0.2 | 0.16 | 0.31 | 0.22 | 0.2 | 0.25 |
| (27) Solidification coefficient | $k = Lf/\sqrt{\bar{A}_L}$ | | 69.0 | 153.8 | 110.0 | 44.9 | 137.5 | 125 | 138.9 |
| (28) Packing fraction | $Pf = \bar{A}_L \cdot \bar{n}$ | | $1.5 \times 10^{-3}$ | $4.9 \times 10^{-4}$ | $1.1 \times 10^{-3}$ | $1.6 \times 10^{-3}$ | $5.0 \times 10^{-4}$ | $1.4 \times 10^{-3}$ | $1.4 \times 10^{-3}$ |
| (29) Spinning stress | f | g/de | 0.019 | 0.060 | 0.024 | 0.014 | 0.042 | 0.023 | 0.021 |

| Example<br>Spinning embodiment | 8<br>2nd | 9<br>2nd | 10<br>2nd | 11<br>2nd | 12<br>2nd | 13<br>2nd | 14<br>2nd | 15<br>2nd |
|---|---|---|---|---|---|---|---|---|
| Spinneret | | | | | | | | |

TABLE 1-continued

| | | | | | | | | | | |
|---|---|---|---|---|---|---|---|---|---|---|
| (1) Material for the extrusion surface | | | twill weave mesh | twill weave mesh | twill weave mesh | twill weave mesh | twill weave mesh | twill weave mesh | twill weave mesh | plain weave mesh |
| (2) Total fiber-forming area | So | $cm^2$ | 32 | 32 | 32 | 32 | 32 | 32 | 32 | 32 |
| (3) Average distance between extrusion openings | $\bar{P}$ | mm | 0.380 | 0.380 | 0.380 | 0.380 | 0.380 | 0.380 | 0.380 | 0.443 |
| (4) Average hill height | $\bar{h}$ | mm | 0.109 | 0.109 | 0.109 | 0.109 | 0.109 | 0.109 | 0.109 | 0.239 |
| (5) Average hill width | $\bar{d}$ | mm | 0.300 | 0.300 | 0.300 | 0.300 | 0.300 | 0.300 | 0.300 | 0.277 |
| | $\bar{h}/\bar{d}$ | | 0.363 | 0.363 | 0.363 | 0.363 | 0.363 | 0.363 | 0.363 | 0.502 |
| | $(\bar{P} - \bar{d})/\bar{P}$ | | 0.211 | 0.211 | 0.211 | 0.211 | 0.211 | 0.211 | 0.211 | 0.375 |
| (6) Number of elevations | $n_{(m)}$ | $N/cm^2$ | 760 | 760 | 760 | 760 | 760 | 760 | 760 | 223 |
| Polymer | | | | | | | | | | |
| (7) Type | | | PE | P.ST | Ny | PBT | PC | PET | PEs-Elas | PP |
| (8) Density (at room temperature) | $\rho$ | $g/cm^3$ | 0.95 | 1.05 | 1.14 | 1.31 | 1.20 | 1.37 | 1.20 | 0.91 |
| (9) Melting point | Tm | °K. | 404 | 473 | 496 | 496 | 513 | 540 | 484 | 440 |
| (10) Viscosity (at 1.1 Tm) | $\eta$ | poise | 2,000 | 3,300 | 3,300 | 2,000 | 10,000 | 1,200 | 3,600 | 2,300 |
| Primary | | | | | | | | | | |
| (11) Polymer temperature (at x = −0.5) | $t_{-5}$ | °C. | 205 | 260 | 267 | 270 | 260 | 280 | 245 | 250 |
| (12) Polymer temperature (at x = −0.2) | $t_{-2}$ | °C. | 168 | 220 | 223 | 230 | 251 | 269 | 230 | 216 |
| (13) Total amount of extrusion | W | g/min | 41 | 48 | 50 | 55 | 57 | 54 | 56 | 25 |
| (14) Velocity of cooling air (at x = 0.5) | $v_y$ | m/sec | 11 | 9 | 10 | 13 | 9 | 10 | 11 | 6.5 |
| (15) Take-up speed | $V_L$ | cm/min | 450 | 400 | 900 | 2,300 | 650 | 1,000 | 600 | 2,700 |
| Secondary | | | | | | | | | | |
| (16) Polymer temperature (at x ≈ 0) | $t_o = (5 \cdot t - 2) - (2 \cdot t - 5)/3$ | °C. | 143 | 193 | 196 | 203 | 245 | 262 | 220 | 193 |
| (17) Relative temperature | $\theta = (t_o + 273)/Tm$ | | 1.03 | 0.99 | 0.95 | 0.96 | 1.01 | 0.99 | 1.02 | 1.06 |
| (18) Amount of extrusion per $cm^2$ | $w = W/So$ | $g/min \cdot cm^2$ | 1.28 | 1.50 | 1.56 | 1.73 | 1.78 | 1.69 | 1.75 | 0.78 |
| (19) Apparent draw ratio | $Da = V_L\rho/w$ | | 330 | 280 | 657 | 1,752 | 438 | 811 | 411 | 3,804 |
| (20) Total denier | $\Sigma De = (W/V_L) \cdot 9 \times 10^5$ | de | $0.82 \times 10^5$ | $1.08 \times 10^5$ | $0.5 \times 10^5$ | $0.22 \times 10^5$ | $0.79 \times 10^5$ | $0.49 \times 10^5$ | $0.84 \times 10^5$ | $0.08 \times 10^5$ |
| (21) Denier per $cm^2$ | $\Sigma De/So$ | $de/cm^2$ | 2,563 | 3,375 | 1,563 | 688 | 2,469 | 1,531 | 2,625 | 250 |
| Resulting | | | | | | | | | | |
| (22) Average single filament denier | $\overline{De}$ | de | 9.0 | 9.5 | 5.0 | 2.1 | 7.4 | 6.1 | 5.4 | 1.1 |
| (23) Total number of filaments | $N = \Sigma De/\overline{De}$ | | 9,111 | 11,368 | 10,000 | 10,476 | 10,675 | 8,033 | 15,555 | 7,040 |
| (24) Number of filaments per $cm^2$ | $\bar{n} = N/So$ | $1/cm^2$ | 285 | 355 | 313 | 327 | 334 | 251 | 486 | 220 |
| (25) Solidification cross-sectional area | $A_L = \frac{\overline{De}}{9 \times \rho} \times 10^{-5}$ | $cm^2$ | $1.06 \times 10^{-5}$ | $1.01 \times 10^{-5}$ | $0.49 \times 10^{-5}$ | $0.18 \times 10^{-5}$ | $0.69 \times 10^{-5}$ | $0.51 \times 10^{-5}$ | $0.5 \times 10^{-5}$ | $0.13 \times 10^{-5}$ |
| (26) Solidification length | $\bar{L}f$ | cm | 0.21 | 0.23 | 0.18 | 0.20 | 0.20 | 0.23 | 0.20 | 0.11 |
| (27) Solidification coedfficient | $k = Lf/\sqrt{\bar{A}_L}$ | | 64.4 | 72.8 | 81.4 | 149.3 | 76.0 | 101.8 | 89.3 | 96.5 |
| (28) Packing fraction | $Pf = \bar{A}_L \cdot \bar{n}$ | | $3.0 \times 10^{-3}$ | $3.6 \times 10^{-3}$ | $1.5 \times 10^{-3}$ | $5.9 \times 10^{-4}$ | $2.3 \times 10^{-3}$ | $1.3 \times 10^{-3}$ | $2.4 \times 10^{-3}$ | $2.9 \times 10^{-4}$ |
| (29) Spinning stress | f | g/de | 0.016 | 0.013 | 0.026 | 0.042 | 0.015 | 0.021 | 0.018 | 0.062 |
| Example Spinning embodiment | | | 16 2nd | 17 2nd | 18 2nd | 19 2nd | 20 2nd | 21 2nd | 22 2nd | 23 2nd |
| Spinneret | | | | | | | | | | |
| (1) Material for the extrusion surface | | | plain weave mesh | plain weave mesh | twill weave mesh | plain weave mesh | plain weave mesh | plain weave mesh | plain weave mesh | plain weave mesh |
| (2) Total fiber-forming area | So | $cm^2$ | 32 | 32 | 3,000 | 500 | 500 | 3,000 | 500 | 500 |
| (3) Average distance between | $\bar{P}$ | mm | 0.443 | 1.247 | 0.380 | 0.199 | 0.285 | 0.199 | 0.443 | 0.166 |

TABLE 1-continued

| | | | | | | | | | | |
|---|---|---|---|---|---|---|---|---|---|---|
| extrusion openings | | | | | | | | | | |
| (4) Average hill height | $\bar{h}$ | mm | 0.139 | 0.268 | 0.109 | 0.061 | 0.109 | 0.061 | 0.139 | 0.050 |
| (5) Average hill width | $\bar{d}$ | mm | 0.277 | 0.673 | 0.300 | 0.131 | 0.201 | 0.131 | 0.277 | 0.108 |
| | $\bar{h}/\bar{d}$ | | 0.502 | 0.398 | 0.363 | 0.466 | 0.542 | 0.466 | 0.502 | 0.463 |
| | $(\bar{P} - \bar{d})/\bar{P}$ | | 0.375 | 0.460 | 0.211 | 0.342 | 0.295 | 0.342 | 0.375 | 0.349 |
| (6) Number of elevations | $n_{(m)}$ | N/cm$^2$ | 223 | 40 | 760 | 1,396 | 530 | 1,396 | 223 | 2,006 |
| Polymer | | | | | | | | | | |
| (7) Type | | | PP | PP | PP | PP | Ny | PBT | PE | PET |
| (8) Density (at room temperature) | $\rho$ | g/cm$^3$ | 0.91 | 0.91 | 0.91 | 0.91 | 1.14 | 1.2 | 0.94 | 1.39 |
| (9) Melting point | Tm | °K. | 440 | 440 | 438 | 438 | 488 | 505 | 413 | 538 |
| (10) Viscosity (at 1.1 Tm) | $\eta$ | poise | 2,300 | 2,300 | 1,100 | 1,100 | 3,300 | 2,000 | 2,000 | 1,000 |
| Primary | | | | | | | | | | |
| (11) Polymer temperature (at x = −0.5) | $t_{-5}$ | °C. | 262 | 180 | 242 | 240 | 275 | 278 | 210 | 305 |
| (12) Polymer temperature (at x = −0.2) | $t_{-2}$ | °C. | 222 | 165 | 202 | 200 | 256 | 259 | 193 | 297 |
| (13) Total amount of extrusion | W | g/min | 160 | 42 | 1,070 | 136 | 170 | 1,540 | 140 | 204 |
| (14) Velocity of cooling air (at x = 0.5) | $v_y$ | m/sec | 20 | 11 | 10 | 7 | 7 | 10 | 7 | 17 |
| (15) Take-up speed | $V_L$ | cm/min | 3,200 | 1,000 | 875 | 612 | 612 | 612 | 640 | 800 |
| Secondary | | | | | | | | | | |
| (16) Polymer temperature (at x ≈ 0) | $t_o = (5 \cdot t - 2) - (2 \cdot t - 5)/3$ | °C. | 195 | 155 | 176 | 173 | 244 | 247 | 181 | 292 |
| (17) Relative temperature | $\theta = (t_o + 273)Tm$ | | 1.06 | 0.97 | 1.02 | 1.02 | 1.06 | 1.03 | 1.1 | 1.05 |
| (18) Amount of extrusion per cm$^2$ | $w = W/So$ | g/min · cm$^2$ | 5.0 | 1.31 | 0.36 | 0.27 | 0.34 | 0.51 | 0.28 | 0.41 |
| (19) Apparent draw ratio | $Da = V_L\rho/w$ | | 582 | 695 | 2,112 | 2,063 | 2,052 | 1,572 | 2,149 | 2,673 |
| (20) Total denier | $\Sigma De = (W/V_L) \cdot 9 \times 10^5$ | de | $0.45 \times 10^5$ | $0.38 \times 10^5$ | $11 \times 10^5$ | $2 \times 10^5$ | $2.5 \times 10^5$ | $22.6 \times 10^5$ | $2.0 \times 10^5$ | $2.3 \times 10^5$ |
| (21) Denier per cm$^2$ | $\Sigma De/So$ | de/cm$^2$ | 1,406 | 1,188 | 367 | 400 | 500 | 755 | 400 | 460 |
| Resulting | | | | | | | | | | |
| (22) Average single filament denier | $\overline{De}$ | de | 6.0 | 31 | 0.9 | 0.7 | 1.6 | 2.0 | 4.2 | 1.3 |
| (23) Total number of filaments | $N = \Sigma De/\overline{De}$ | | 7,500 | 1,226 | 1,222,222 | 285,714 | 156,250 | 1,130,000 | 47,619 | 176,923 |
| (24) Number of filaments per cm$^2$ | $\bar{n} = N/So$ | 1/cm$^2$ | 234 | 38 | 407 | 571 | 313 | 377 | 95 | 354 |
| (25) Solidification cross-sectional area | $A_L = \frac{\overline{De}}{9 \times \rho} \times 10^{-5}$ | cm$^2$ | $0.73 \times 10^{-5}$ | $3.8 \times 10^{-5}$ | $0.11 \times 10^{-5}$ | $0.09 \times 10^{-5}$ | $0.16 \times 10^{-5}$ | $0.19 \times 10^{-5}$ | $0.5 \times 10^{-5}$ | $0.11 \times 10^{-5}$ |
| (26) Solidification length | $\bar{L}f$ | cm | 0.28 | 0.6 | 0.30 | 0.14 | 0.17 | 0.33 | 0.38 | 0.22 |
| (27) Solidification coefficient | $k = Lf/\sqrt{\bar{A}_L}$ | | 103.7 | 96.8 | 285.7 | 147.7 | 135.0 | 239.1 | 170.0 | 209.5 |
| (28) Packing fraction | $Pf = \bar{A}_L \cdot \bar{n}$ | | $1.8 \times 10^{-3}$ | $1.4 \times 10^{-3}$ | $4.5 \times 10^{-4}$ | $5.1 \times 10^{-4}$ | $5.0 \times 10^{-4}$ | $7.2 \times 10^{-4}$ | $4.8 \times 10^{-4}$ | $3.9 \times 10^{-4}$ |
| (29) Spinning stress | f | g/de | 0.012 | 0.021 | 0.050 | 0.089 | 0.028 | 0.014 | 0.012 | 0.021 |
| Example | | | 24 | 25 | 26 | 27 | 28 | 29 | 30 | 31 |
| Spinning embodiment | | | 2nd | 2nd | 4th | 4th | 4th | 4th | 2nd | 2nd |
| Spinneret | | | | | | | | | | |
| (1) Material for the extrusion surface | | | plain weave mesh | plain weave mesh | sintered metal balls | sintered metal balls | sintered metal balls | sintered metal balls | plain weave mesh | twill weave mesh |
| (2) Total fiber-forming area | So | cm$^2$ | 32 | 32 | 500 | 500 | 500 | 500 | 500 | 32 |
| (3) Average distance between extrusion openings | $\bar{P}$ | mm | 0.443 | 0.570 | 0.530 | 0.530 | 0.428 | 0.32 | 0.199 | 0.212 |
| (4) Average hill height | $\bar{h}$ | mm | 0.139 | 0.188 | 0.224 | 0.224 | 0.181 | 0.145 | 0.061 | 0.160 |
| (5) Average hill width | $\bar{d}$ | mm | 0.277 | 0.368 | 0.448 | 0.448 | 0.361 | 0.29 | 0.131 | 0.158 |
| | $\bar{h}/\bar{d}$ | | 0.502 | 0.511 | 0.50 | 0.50 | 0.50 | 0.50 | 0.466 | 1.012 |

TABLE 1-continued

| | | | | | | | | | | |
|---|---|---|---|---|---|---|---|---|---|---|
| | $(\bar{P} - \bar{d})/\bar{P}$ | | 0.375 | 0.354 | 0.155 | 0.155 | 0.157 | 0.09 | 0.342 | 0.255 |
| (6) Number of elevations | $n_{(m)}$ | $N/cm^2$ | 223 | 135 | 322 | 322 | 496 | 3,103 | 1,396 | 388 |
| Polymers | | | | | | | | | | |
| (7) Type | | | PET | Ny | PE | Ny | Ny 70/PP 30 | PBT 60/PE 40 | Foamed PP 60/Ny 40 | PP |
| (8) Density (at room temperature) | $\rho$ | $g/cm^3$ | 1.37 | 1.14 | 0.94 | 1.14 | 1.07 | 1.16 | 1.10 | 0.91 |
| (9) Melting point | Tm | °K. | 540 | 496 | 410 | 488 | 479 | 465 | 461 | 440 |
| (10) Viscosity (at 1.1 Tm) | $\eta$ | poise | 1,200 | 3,300 | 2,000 | 7,000 | 3,000 | 2,000 | 3,500 | 2,300 |
| Primary | | | | | | | | | | |
| (11) Polymer temperature (at $x = 10^{-0.5}$) | $t_{-5}$ | °C. | 272 | 260 | 220 | 270 | 265 | 270 | 270 | 295 |
| (12) Polymer temperature (at $x = 10^{-0.2}$) | $t_{-2}$ | °C. | 254 | 225 | 200 | 243 | 249 | 237 | 243 | 210 |
| (13) Total amount of extrusion | W | g/min | 70 | 67 | 140 | 170 | 160 | 172 | 150 | 120 |
| (14) Velocity of cooling air (at x = 0.5) | $v_y$ | m/sec | 11 | 10 | 7 | 7 | 7 | 10 | 7 | 10 |
| (15) Take-up speed | $V_L$ | cm/min | 1,200 | 620 | 280 | 600 | 1,200 | 280 | 675 | 1,000 |
| Secondary | | | | | | | | | | |
| (16) Polymer temperature (at $x \approx 0$) | $t_o = (5 \cdot t - 2) - (2 \cdot t - 5)/3$ | °C. | 242 | 200 | 186 | 225 | 239 | 215 | 225 | 153 |
| (17) Relative temperature | $\theta = (t_o = 273)/Tm$ | | 0.95 | 0.95 | 1.12 | 1.02 | 1.07 | 1.05 | 1.02 | 0.97 |
| (18) Amount of extrusion per $cm^2$ | $w = W/So$ | $g/min \cdot cm^2$ | 2.19 | 2.09 | 0.28 | 0.34 | 0.32 | 0.34 | 0.30 | 3.75 |
| (19) Apparent draw ratio | $Da = V_L\rho/w$ | | 751 | 338 | 940 | 2,012 | 4,013 | 955 | 2,250 | 243 |
| (20) Total denier | $\Sigma De = (W/V_L) \cdot 9 \times 10^5$ | de | $0.52 \times 10^5$ | $0.97 \times 10^5$ | $4.5 \times 10^5$ | $2.5 \times 10^5$ | $1.2 \times 10^5$ | $5.5 \times 10^5$ | $2.0 \times 10^5$ | $1.08 \times 10^5$ |
| (21) Denier per $cm^2$ | $\Sigma De/So$ | $de/cm^2$ | 1,625 | 3,031 | 900 | 500 | 240 | 1,100 | 400 | 3,375 |
| Resulting | | | | | | | | | | |
| (22) Average single filament denier | $\overline{De}$ | de | 7.7 | 28 | 3.4 | 2.7 | 0.9 | 1.6 | 1.2 | 17.0 |
| (23) Total number of filaments | $N = \Sigma De/\overline{De}$ | | 6,753 | 3,464 | 132,353 | 92,593 | 13,333 | 343,750 | 166,667 | 6,350 |
| (24) Number of filaments per $cm^2$ | $\bar{n} = N/So$ | $1/cm^2$ | 211 | 108 | 265 | 185 | 267 | 688 | 333 | 198 |
| (25) Solidification cross-sectional area | $A_L = \frac{\overline{De}}{9 \times \rho} \times 10^{-5}$ | $cm^2$ | $0.62 \times 10^{-5}$ | $2.7 \times 10^{-5}$ | $0.4 \times 10^{-5}$ | $0.26 \times 10^{-5}$ | $0.09 \times 10^{-5}$ | $0.15 \times 10^{-5}$ | $0.13 \times 10^{-5}$ | $2.1 \times 10^{-5}$ |
| (26) Solidification length | $\bar{L}f$ | cm | 0.26 | 0.8 | 0.19 | 0.20 | 0.23 | 0.30 | 0.22 | 0.30 |
| (27) Solidification coefficient | $k = Lf/\sqrt{\bar{A}_L}$ | | 104 | 154 | 9.5 | 125 | 242 | 246 | 193 | 65.5 |
| (28) Packing fraction | $Pf = \bar{A}_L \cdot \bar{n}$ | | $1.3 \times 10^{-3}$ | $2.9 \times 10^{-3}$ | $1.1 \times 10^{-5}$ | $4.8 \times 10^{-4}$ | $2.4 \times 10^{-4}$ | $1.0 \times 10^{-3}$ | $4.3 \times 10^{-4}$ | $4.2 \times 10^{-3}$ |
| (29) Spinning stress | f | g/de | 0.020 | 0.024 | 0.031 | 0.025 | 0.029 | 0.018 | 0.015 | 0.025 |

| | | | | | | | | |
|---|---|---|---|---|---|---|---|---|
| | Example | | 1 | 2 | 3 | 4 | 5 |
| | Spinning embodiment | | 2nd | 2nd | — | — | — |
| Spinneret | | | | | | | |
| (1) Material for the extrusion surface | | | plain weave mesh | plain weave mesh | flat plate with orifices | plain weave mesh | Ring-like slit $\phi$ 14 × slit 0.025 |
| (2) Total fiber-forming area | So | $cm^2$ | 32 | 32 | 11.1 | 32 | — |
| (3) Average distance between extrusion openings | $\bar{P}$ | mm | 0.020 | 4.08 | 2.22 | 0.380 | — |
| (4) Average hill height | $\bar{h}$ | mm | 0.007 | 0.462 | 0 | 0.109 | — |
| (5) Average hill width | $\bar{d}$ | mm | 0.010 | 1.308 | 1.83 | 0.300 | — |
| | $\bar{h}/\bar{d}$ | | 0.70 | 0.353 | 0 | 0.363 | — |
| | $(\bar{P} - \bar{d})/\bar{P}$ | | 0.50 | 0.673 | 0.176 | 0.211 | — |
| (6) Number of elevations | $n_{(m)}$ | $N/cm^2$ | 155,000 | 4.0 | 90 | 760 | — |
| Polymers | | | | | | | |
| (7) Type | | | PP | PP | PP | PP | PP |

TABLE 1-continued

| | | | | | | | |
|---|---|---|---|---|---|---|---|
| (8) Density (at room temperature) | $\rho$ | g/cm$^3$ | 0.91 | 0.91 | 0.91 | 0.91 | 0.91 |
| (9) Melting point | Tm | °K. | 440 | 440 | 440 | 440 | 440 |
| (10) Viscosity (at 1.1 Tm) | $\eta$ | poise | 2,300 | 2,300 | 2,300 | 2,300 | 2,300 |
| Primary | | | | | | | |
| (11) Polymer temperature (at x = −0.5) | $t_{-5}$ | °C. | 250 | ~250~ | ~250~ | ~193~ | 280 |
| (12) Polymer temperature (at x = −0.2) | $t_{-2}$ | °C. | 216 | ~216~ | ~216~ | ~193~ | 240 |
| (13) Total amount of extrusion | W | g/min | 42 | 42 | 12 | ~42~ | 45 |
| (14) Velocity of cooling air | $v_y$ | m/sec | ~14~ | ~14~ | ~14~ | 0 | 8 |
| (15) Take-up speed | $V_L$ | cm/min | ~1,000~ | ~1,000~ | ~800~ | — | 6,250 |
| Secondary | | | | | | | |
| (16) Polymer temperature (at x ≈ 0) | $t_o = (5 \cdot t - 2) - (2 \cdot t - 5)/3$ | °C. | ~193~ | ~193~ | ~193~ | ~193~ | 220 |
| (17) Relative temperature | $\theta = (t_o + 273)/Tm$ | | ~1.06~ | ~1.06~ | ~1.06~ | ~1.06~ | 1.12 |
| (18) Amount of extrusion per cm$^2$ | $w = W/So$ | g/min · cm$^2$ | 1.31 | 1.31 | 1.08 | 1.31 | 40.9 |
| (19) Apparent draw ratio | $Da = V_L\rho/w$ | | — | — | — | — | 139.11 |
| (20) Total denier | $\Sigma De = (W/V_L) \cdot 9 \times 10^5$ | de | — | — | — | — | $0.06 \times 10^5$ |
| (21) Denier per cm$^2$ | $\Sigma De/So$ | de/cm$^2$ | — | — | — | — | 5,455 |
| Resulting | | | | | | | |
| (22) Average single filament denier | $\overline{De}$ | de | — | — | — | — | 6.9 |
| (23) Total number of filaments | $N = \Sigma De/\overline{De}$ | | — | — | — | — | — |
| (24) Number of filaments per cm$^2$ | $\bar{n} = N/So$ | 1/cm$^2$ | — | — | — | — | — |
| (25) Solidification cross-sectional area | $A_L = \frac{\overline{De}}{9 \times \rho} \times 10^{-5}$ | cm$^2$ | — | — | — | — | — |
| (26) Solidification length | $\bar{L}f$ | cm | — | — | — | — | — |
| (27) Solidification coefficient | $k = Lf/\sqrt{\overline{A_L}}$ | | — | — | — | — | — |
| (28) Packing fraction | $Pf = \overline{A_L} \cdot \bar{n}$ | | — | — | — | — | — |
| (29) Spinning stress | f | g/de | — | — | — | — | — |

TABLE 2

| Item | Symbol | Unit | Example 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|---|
| Before drawing | | | | | | | | | | | | | | | | | | |
| (A) Coefficient of intrafilament cross-sectional area variation | CV(F) | | 0.18 | 0.29 | 0.15 | 0.46 | 0.16 | 0.59 | 0.30 | 0.13 | 0.22 | 0.21 | 0.15 | 0.19 | 0.18 | 0.25 | 0.27 | 0.31 |
| (B) Intrafilament irregular shape factor | $\overline{(D/d)}_F$ | | 1.22 | 1.36 | 2.62 | 1.24 | 1.50 | 3.41 | 3.53 | 2.48 | 2.23 | 2.47 | 2.60 | 1.70 | | 2.45 | 1.25 | 1.33 |
| (C) Maximum difference in intrafilament irregular shape factor | DIF | | 0.13 | 0.30 | 1.60 | 0.16 | 0.30 | 5.50 | 5.40 | 0.60 | 0.50 | 0.80 | 1.20 | 0.35 | | 0.70 | 0.40 | 0.50 |
| (D) Filament tenacity | Ten | g/de | 1.51 | 0.96 | 1.50 | 1.01 | 1.11 | 0.64 | 0.98 | 0.65 | 0.68 | 1.52 | 1.01 | 1.22 | 1.22 | 0.81 | 1.50 | 1.98 |
| (E) Filament elongation | El | % | 246 | 150 | 222 | 324 | 380 | 100 | 160 | 672 | 3 | 91 | 75 | 71 | 199 | 181 | 173 | 386 |
| (F) Number of crimps (upon boiling water treatment) | $n_s$ | n/20$^{mm}$ | 6.8 | 6.5 | 9.4 | 6.4 | 6.6 | 4.2 | 6.5 | 2.7 | 15.8 | 10.6 | 12.1 | | 15.4 | 16.5 | 7.0 | 7.2 |
| (G) Coefficient of intrabundle cross-sectional area variation | CV(B) | | 0.37 | 0.49 | 0.33 | 0.53 | 0.81 | 0.83 | 0.59 | 0.28 | 0.31 | | 0.28 | 0.17 | 0.17 | 0.13 | 0.35 | 0.42 |
| (H) Intrabundle irregular shape factor | $\overline{(D/d)}_B$ | | 1.20 | 1.46 | 2.83 | 1.26 | 1.52 | 3.45 | 3.58 | 2.54 | 2.35 | | 2.66 | 1.74 | 2.46 | | 1.32 | 1.41 |
| (I) Maximum difference in intrabundle irregular shape factor | DIF | | 0.22 | 0.30 | 2.73 | 0.40 | 0.36 | 5.70 | 5.60 | 0.80 | 0.60 | | 0.34 | 0.37 | 1.20 | | 0.50 | 0.60 |
| (J) Average distance between bonded points | $\bar{b}$ | m | | 6.0 | | | | 0.9 | 0.8 | | | | | | | | | |
| After drawing | | | | | | | | | | | | | | | | | | |
| (A) Coefficient of intrafilament cross-sectional area variation | CV(F) | | | | 0.20 | | | 0.67 | 0.54 | 0.25 | 0.17 | 0.10 | 0.20 | 0.16 | 0.10 | 0.18 | 0.19 | 0.34 |
| (B) Intrafilament irregular shape factor | $\overline{(D/d)}_F$ | | | 1.44 | 4.92 | | 1.32 | 3.30 | 3.42 | 3.05 | 2.15 | | 2.59 | 1.89 | 2.81 | 3.35 | 1.38 | 1.31 |
| (C) Maximum difference in intrafilament irregular shape factor | DIF | | | 0.71 | 6.20 | | 0.44 | 5.60 | 5.10 | 2.30 | 0.50 | | 1.91 | 0.43 | 1.36 | 2.00 | 0.62 | 0.65 |
| (D) Filament tenacity | Ten | g/de | | 3.20 | 4.68 | | | | | 1.43 | 0.70 | 2.86 | 1.69 | 1.82 | 2.86 | 1.56 | 2.60 | 4.94 |
| (E) Filament elongation | El | % | | 18.0 | 20.0 | | | | | 20.0 | 3 | 26 | 18 | 25 | 15 | 92 | 22 | 24 |
| (F) Number of crimps (upon boiling water treatment) | $n_s$ | n/20$^{mm}$ | | | | | | | | | | 7.2 | 4.4 | 2.1 | 7.2 | 11.3 | 4.2 | 2.1 |
| (G) Coefficient of intrabundle cross-sectional area variation | CV(B) | | | 0.25 | 0.29 | | 0.45 | 0.85 | 0.60 | 0.72 | | | 0.26 | 0.22 | 0.25 | 0.24 | 0.28 | 0.36 |
| (H) Intrabundle irregular shape factor | $\overline{(D/d)}_B$ | | | 1.52 | 5.10 | | 1.38 | 4.13 | 3.51 | | | | 2.73 | | | | 1.32 | 1.34 |
| (I) Maximum difference in intrabundle irregular shape factor | DIF | | | 0.75 | 6.40 | | 0.49 | 6.00 | 5.40 | | | | 1.90 | | | | 0.71 | 0.63 |

| Item | Symbol | Unit | Example 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|
| Before drawing | | | | | | | | | | | | | | | | | |
| (A) Coefficient of intrafilament cross-sectional area variation | CV(F) | | 0.21 | 0.33 | 0.21 | 0.26 | 0.34 | 0.19 | 0.21 | 0.39 | 0.24 | 0.53 | 0.19 | 0.36 | 0.49 | 0.58 | 0.28 |
| (B) Intrafilament irregular shape factor | $\overline{(D/d)}_F$ | | 1.26 | 3.20 | 1.31 | 1.29 | 1.34 | 1.32 | 1.28 | 1.33 | | 1.38 | 1.43 | 1.67 | 1.84 | 2.45 | 1.96 |
| (C) Maximum difference in intrafilament irregular shape factor | DIF | | 0.40 | 1.90 | 0.51 | 0.54 | 0.63 | 0.55 | 0.41 | 0.50 | 1.28 | 0.46 | 0.32 | 0.50 | 0.59 | 1.72 | 1.8 |
| (D) Filament tenacity | Ten | g/de | 1.24 | 1.50 | 1.50 | 2.11 | 1.50 | 0.66 | 1.24 | 0.82 | 1.18 | 0.52 | 1.52 | 1.80 | 1.10 | 1.20 | 0.92 |
| (E) Filament elongation | El | % | 324 | 236 | 320 | 290 | 110 | 580 | 203 | 231 | 69 | 425 | 95 | 320 | 190 | 83 | 184 |
| (F) Number of crimps (upon boiling water treatment) | $n_s$ | n/20$^{mm}$ | 5.4 | 6.7 | 6.3 | 16.9 | 12.3 | 2.9 | 14.7 | 16.2 | 12.4 | 2.4 | 10.9 | 21.4 | 18.6 | 19.1 | 6.5 |
| (G) Coefficient of intrabundle cross-sectional area variation | CV(B) | | 0.29 | 0.35 | 0.35 | 0.50 | 0.50 | 0.42 | 0.31 | 0.41 | 0.40 | 0.70 | 0.31 | 0.90 | 1.00 | 0.62 | 0.31 |
| (H) Intrabundle irregular shape factor | $\overline{(D/b)}_B$ | | 1.34 | 3.40 | 1.28 | 1.33 | 1.32 | 1.36 | 1.30 | 1.35 | 0.38 | 1.57 | 1.46 | 1.71 | 1.92 | 2.42 | 2.04 |

TABLE 2-continued

| | | | | | | | | | | | | | | | | | |
|---|---|---|---|---|---|---|---|---|---|---|---|---|---|---|---|---|---|
| (I) Maximum difference in intrabundle irregular shape factor | DIF | | 0.50 | 0.37 | 0.65 | 0.71 | 0.73 | 0.52 | 0.50 | 0.61 | 0.60 | 0.62 | 0.45 | 0.75 | 0.80 | 1.93 | 2.0 |
| (J) Average distance between bonded points | $\bar{b}$ | m | | 1.0 | 1.7 | 2.0 | 2.0 | | 2.0 | | | 10.0 | 10.0 | 4.0 | 5.0 | 2.0 | |
| After drawing | | | | | | | | | | | | | | | | | |
| (A) Coefficient of intrafilament cross-sectional area variation | CV(F) | | 0.29 | 0.26 | 0.26 | 0.31 | 0.24 | 0.27 | 0.26 | 0.31 | 0.19 | 0.46 | 0.25 | 0.58 | 0.67 | 0.62 | |
| (B) Intrafilament irregular shape factor | $\overline{(D/d)}_F$ | | 1.27 | 3.95 | 1.28 | 1.30 | 1.29 | 1.26 | 1.32 | 1.27 | 1.26 | 1.52 | 1.38 | 1.76 | 2.13 | 2.43 | |
| (C) Maximum difference in intrafilament irregular shape factor | DIF | | 0.51 | 4.30 | 0.40 | 0.50 | 0.43 | 0.41 | 0.55 | 0.51 | 0.42 | 0.60 | 0.43 | 0.89 | 0.92 | 1.60 | |
| (D) Filament tenacity | Ten | g/de | 3.64 | 3.25 | 3.77 | 3.25 | 1.56 | 1.30 | 2.99 | 1.82 | 2.73 | 1.50 | 4.03 | 3.38 | 1.56 | 2.47 | |
| (E) Filament elongation | El | % | 28 | 23 | 26 | 90 | 16 | 22 | 16 | 20 | 70 | 24 | 90 | 24 | 19 | 81 | |
| (F) Number of crimps (upon boiling water treatment) | $n_s$ | $n/20^{mm}$ | 2.2 | 2.5 | 2.4 | 5.6 | 4.7 | 3.4 | 7.1 | 6.5 | 6.7 | 3.6 | 7.1 | 15.4 | 14.6 | 14.3 | |
| (G) Coefficient of intrabundle cross-sectional area variation | CV(B) | | 0.39 | 0.33 | 0.34 | 0.35 | 0.27 | 0.32 | 0.21 | 0.42 | 0.25 | 0.51 | 0.23 | 0.62 | 0.85 | 0.65 | |
| (H) Intrabundle irregular shape factor | $\overline{(D/d)}_B$ | | 1.29 | 4.13 | 1.33 | 1.36 | 1.24 | 1.33 | 1.35 | 1.34 | 1.33 | 1.56 | 1.40 | 1.83 | 2.25 | 2.45 | |
| (I) Maximum difference in intrabundle irregular shape factor | DIF | | 0.64 | 4.52 | 0.51 | 0.63 | 0.49 | 0.50 | 0.58 | 0.63 | 0.60 | 0.68 | 0.51 | 1.10 | 1.23 | 1.88 | |

What we claim is:

1. A process for producing a bundle of filament-like fibers by extruding a melt of a thermoplastic synthetic polymer through a spinneret having numerous small openings, which comprises extruding said melt from said spinneret, said spinneret having such a structure that discontinuous elevations are provided between adjacent small openings on the extruding side of the spinneret, and the melt extruded from one opening can move to and from the melt extruded from another opening adjacent thereto or vice versa through a depression existing between said elevations; and taking out the extrudates from the small openings while cooling them by supplying a cooling fluid to the extrusion surface of said spinneret or to its neighborhood, said cooling fluid being supplied such that the solidification length ($L_f$) which is defined as the distance from the surface of the elevations of the spinneret to a point at which the fine fibrous streams have a diameter 1.1 times as large as the fixed fiber diameter, is less than 1 cm, whereby said extrudates are converted into numerous separated fine fibrous streams and solidified.

2. The process of claim 1 wherein said fine fibrous streams are taken up such that the packing fraction ($P_f$), as defined in the specification, is in the range of $10^{-4}$ to $10^{-1}$.

3. A process for producing a bundle of crimped filament-like fibers, which comprises heat-treating the bundle obtained by the process of claim 1.

4. A process for producing a bundle of filament-like fibers which comprises drawing the bundle obtained by the process of claim 1.

5. A process for producing a bundle of crimped filament-like fibers, which comprises drawing the bundle obtained by the process of claim 1, and then heat-treating it.

* * * * *